US007701425B2

(12) United States Patent
Morita et al.

(10) Patent No.: US 7,701,425 B2
(45) Date of Patent: Apr. 20, 2010

(54) DISPLAY DRIVER AND ELECTRO-OPTICAL DEVICE

(75) Inventors: Akira Morita, Suwa (JP); Yuichi Toriumi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1219 days.

(21) Appl. No.: 10/886,588

(22) Filed: Jul. 9, 2004

(65) Prior Publication Data

US 2005/0030303 A1 Feb. 10, 2005

(30) Foreign Application Priority Data

Jul. 18, 2003 (JP) ..... 2003-277027

(51) Int. Cl.
*G09G 3/36* (2006.01)

(52) U.S. Cl. ..... 345/87; 345/100

(58) Field of Classification Search ..... 345/87–104
See application file for complete search history.

(56) References Cited

U.S. PATENT DOCUMENTS

| | | | | |
|---|---|---|---|---|
| 5,724,061 | A * | 3/1998 | Kanbara | 345/100 |
| 5,724,269 | A * | 3/1998 | Pedroni et al. | 702/191 |
| 6,018,331 | A * | 1/2000 | Ogawa | 345/99 |
| 6,680,722 | B1 * | 1/2004 | Hiraki et al. | 345/96 |
| 6,724,363 | B1 * | 4/2004 | Satoh et al. | 345/100 |
| 6,731,263 | B2 * | 5/2004 | Goto et al. | 345/100 |
| 7,006,067 | B2 * | 2/2006 | Tobita et al. | 345/92 |
| 2002/0180675 | A1 * | 12/2002 | Tobita et al. | 345/87 |
| 2002/0190973 | A1 | 12/2002 | Morita | |

FOREIGN PATENT DOCUMENTS

| | | |
|---|---|---|
| JP | A 5-264962 | 10/1993 |
| JP | A 9-61788 | 3/1997 |
| JP | A 9-90907 | 4/1997 |
| JP | A 10-161608 | 6/1998 |
| JP | A 2001-34236 | 2/2001 |
| JP | A 2002-351412 | 12/2002 |

OTHER PUBLICATIONS

U.S. Appl. No. 10/891,197, filed Jul. 15, 2004, Morita.

* cited by examiner

*Primary Examiner*—Amr Awad
*Assistant Examiner*—Michael Pervan
(74) *Attorney, Agent, or Firm*—Oliff & Berridge, PLC

(57) ABSTRACT

A display driver including a shift register which shifts a shift start signal based on a shift clock to output a shift output from flip-flops thereof; a shift register control circuit which controls the shift register; a data latch which fetches display data on a display data bus, based on the shift output of the shift register; and a drive circuit which drives data lines based on the display data that has been fetched into the data latch. The shift register control circuit supplies the shift clock to the shift register in a vertical scan period, to cause the shift register to fetch display data for one horizontal scan, then halts the supply of the shift clock, and also supplies the shift clock to the shift register in a vertical blanking period, to clear the contents held in the shift register.

14 Claims, 16 Drawing Sheets

DISPLAY DRIVER AND ELECTRO-OPTICAL DEVICE

Japanese Patent Application No. 2003-277027, filed on Jul. 18, 2003, is hereby incorporated by reference in its entirety.

BACKGROUND OF THE INVENTION

The present invention relates to a display driver and an electro-optical device.

A liquid-crystal display panel of a liquid-crystal display device comprises a plurality of scan lines, a plurality of data lines, and a plurality of pixels such that each pixel is connected to scan lines of the plurality of scan lines and data lines of the plurality of data lines. A data driver supplies drive voltages corresponding to display data through the data lines to the pixels connected to scan lines that have been selected by a scan driver.

The data driver sequentially fetches display data that is input serially in pixel units, into a data latch based on a shift clock. The data driver drives the data lines, based on display data for one horizontal scan that has been fetched into the data latch.

BRIEF SUMMARY OF THE INVENTION

According to one aspect of the present invention, there is provided a display driver which drives a plurality of data lines of a display panel including a plurality of scan lines, the data lines and a plurality of pixels, based on display data, the display driver comprising:

a display data bus to which display data is supplied in accordance with the sequence in which the data lines are arranged;

a shift register which has a plurality of flip-flops connected in series, shifts a shift start signal based on a shift clock, and outputs shift outputs from the flip-flops;

a shift register control circuit which supplies the shift clock and the shift start signal to the shift register;

a data latch which has a plurality of flip-flops and fetches display data on the display data bus, based on the shift outputs from the flip-flops of the shift register; and a drive circuit which drives the data lines, based on the display data that has been fetched into the data latch, wherein:

the shift register control circuit supplies the shift clock to the shift register in a vertical scan period in which the scan lines are scanned, to cause the shift register to fetch display data for one horizontal scan, then halts the supply of the shift clock to the register; and the shift register control circuit supplies the shift clock to the shift register in a vertical blanking period between the vertical scan period and the next vertical scan period, to clear the contents held in the shift register.

According to another aspect of the present invention, there is provided a display driver which drives a plurality of data lines of a display panel including a plurality of scan lines, the data lines and a plurality of pixels, based on display data, the display driver comprising:

a display data bus to which display data is supplied in accordance with the sequence in which the data lines are arranged;

a shift register which has a plurality of flip-flops connected in series, shifts a shift start signal based on a shift clock, and outputs shift outputs from the flip-flops;

a shift register control circuit which supplies the shift clock and the shift start signal to the shift register;

a data latch which has a plurality of flip-flops and fetches display data on the display data bus, based on the shift outputs from the flip-flops of the shift register; and a drive circuit which drives the data lines, based on the display data that has been fetched into the data latch, wherein:

the shift register control circuit supplies the shift clock to the shift register in a vertical scan period in which the scan lines are scanned, to cause the shift register to fetch display data for one horizontal scan, then halts the supply of the shift clock to the register; and the shift register control circuit initializes the flip-flops of the shift register to clear the contents held in the shift register in a vertical blanking period between the vertical scan period and the next vertical scan period.

According to further aspect of the present invention, there is provided an electro-optical device comprising:

a plurality of scan lines;

a plurality of data lines;

a plurality of pixels each of which is connected to one of the scan lines and one of the data lines;

a scan driver which drives the scan lines; and any of the above display drivers which drive the data lines.

DETAILED DESCRIPTION OF THE EMBODIMENT

Embodiments of the present invention will be described below. Note that the embodiments described below do not in any way limit the scope of the invention laid out in the claims herein. In addition, all of the elements of the embodiments described below should not be taken as essential requirements of the present invention.

To enable the installation of a liquid-crystal display device in a portable type of electronic device, an even further reduction in the power consumption is required of the data driver. The data driver drives the data lines based on display data in the current horizontal scan period, and at the same time fetches the display data for the next horizontal scan period. The data driver therefore always consumes power and is thus a major factor in the power consumption of the liquid-crystal display device.

Figure 1:
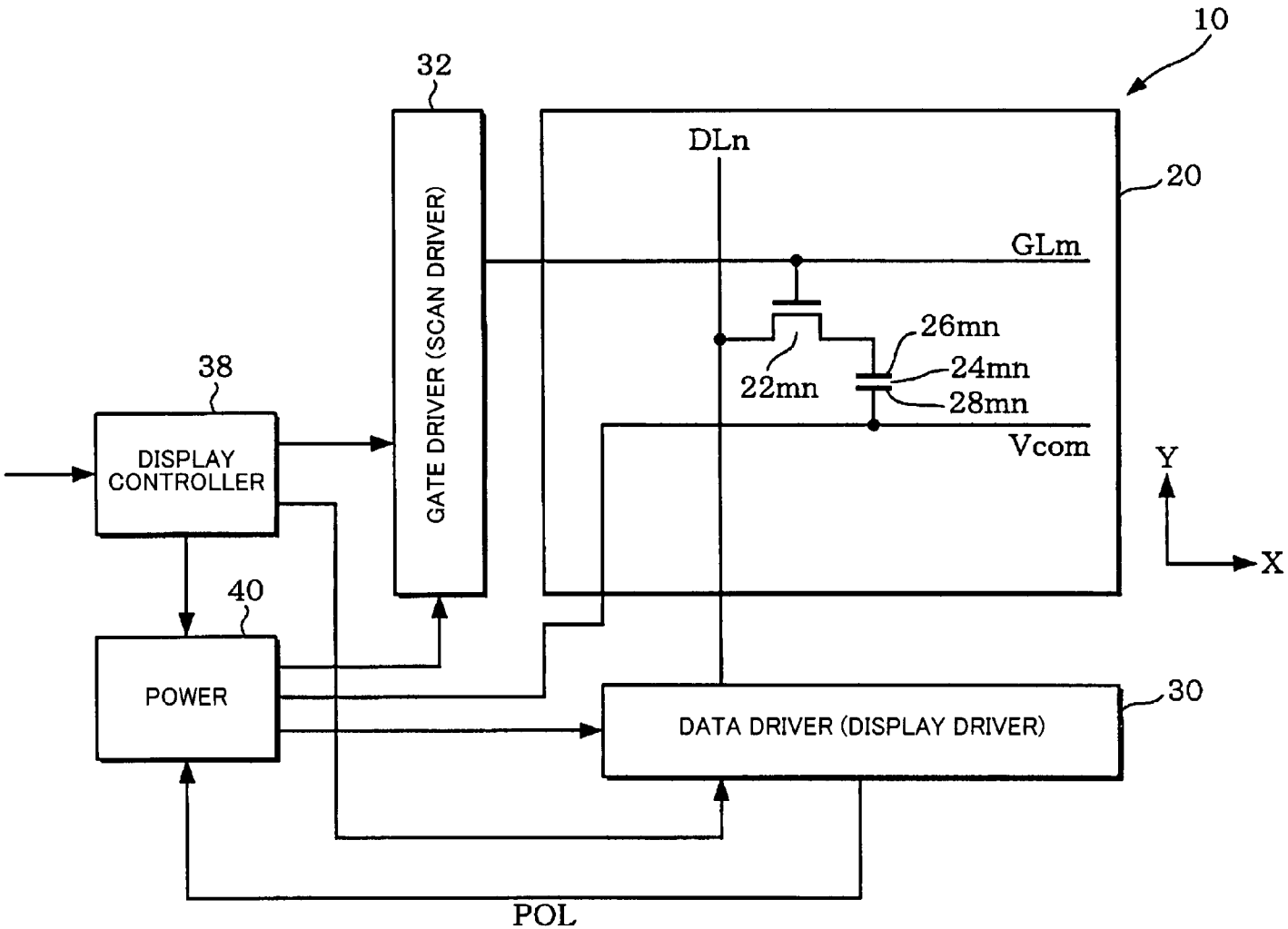
FIG. 1 schematically shows an example of the configuration of an active matrix type of liquid-crystal display device including a display driver according to one embodiment of the present invention.

A technique that focuses on the fetching of display data by this data driver, with the aim of reducing the power consumption of the data driver, is disclosed in Japanese Patent Laid-Open No. 9-90907 (FIG. 1). This Japanese Patent Laid-Open No. 9-90907 discloses a technique that enables the data driver to reduce the frequency of the shift clock.

However, the technique disclosed in Japanese Patent Laid-Open No. 9-90907 fetches display data of the same contents for each of neighboring data lines, into a shift register configured of a data latch. To replace that display data, therefore, the surface area for wiring the bus becomes large. When the number of grayscales is increased, in particular, the bus width increases and thus the surface area required for the wiring also increases, which leads to a higher cost due to the increased surface area of the chip. Since it is now necessary to supply display data every horizontal scan period, in a sequence that differs from that of the prior art, a further problem arises in that the display controller that supplies the display data must be redesigned. Thus the technique disclosed in this Japanese Patent Laid-Open No. 9-90907 leads to an increase in costs.

The embodiment described below makes it possible to provide a display driver that drives the data lines of an electro-optical device based on fetched display data, at a lower cost and also a reduced power consumption, and an electro-optical device provided therewith.

According to one embodiment of the present invention, there is provided a display driver which drives a plurality of data lines of a display panel including a plurality of scan lines, the data lines and a plurality of pixels, based on display data, the display driver comprising:

a display data bus to which the display data is supplied in accordance with the sequence in which the data lines are arranged;

a shift register which has a plurality of flip-flops connected in series, shifts a shift start signal based on a shift clock, and outputs shift outputs from the flip-flops;

a shift register control circuit which supplies the shift clock and the shift start signal to the shift register;

a data latch which has a plurality of flip-flops and fetches display data on the display data bus, based on the shift outputs from the flip-flops of the shift register; and a drive circuit which drives the data lines, based on the display data that has been fetched into the data latch, wherein:

the shift register control circuit supplies the shift clock to the shift register in a vertical scan period in which the scan lines are scanned, to cause the shift register to fetch display data for one horizontal scan, then halts the supply of the shift clock to the register; and the shift register control circuit supplies the shift clock to the shift register in a vertical blanking period between the vertical scan period and the next vertical scan period, to clear the contents held in the shift register.

In this display driver, after the shift register control circuit has supplied the shift clock to the shift register to cause the shift register to fetch display data in the vertical scan period, the shift register control circuit halts the supply of the shift clock to the shift register. This makes it possible to make the shift register stop performing unnecessary shift operations, enabling a reduced power consumption.

In addition, the shift register control circuit can start the shift operation of the shift register in a period unrelated to the display, by supplying the shift clock to the shift register in the vertical blanking period. If the shift operation of the shift register is halted after the display data for one horizontal scan has been fetched, for example, a state could occur in which unpredictable data that is based on pulses generated by noise or the like is fetched into the shift register. In such a case, this unpredictable data could be output from the shift register in a period unrelated to the display. In other words, it is possible to clear the contents held in the shift register (or delete unpredictable data that is based on pulses generated by noise or the like).

Furthermore, since the vertical blanking period is employed instead of the horizontal blanking period, the increase in power consumption entailed by the outputting of data caused by noise due to electrostatic or other sources can be reduced to the reciprocal of the number of horizontal scan periods (or the number of horizontal scan lines) within one vertical scan period.

In this display driver, the shift register control circuit may supply the shift clock to the shift register in one vertical scan period of a plurality of vertical scan periods and a vertical blanking period between one of the vertical scan periods and the next one of the vertical scan periods.

Since this makes it possible to reduce the frequency with which the contents held by the shift register are cleared, it enables a large reduction in the power consumption entailed by the shift operation of the shift register in the vertical blanking period. Moreover, is also extremely effective in reducing the power consumption in cases in which there would be no problems caused by canceling display disruptions every once in a plurality of vertical blanking periods, since human eyes cannot discern display disruptions within one vertical scan period.

In this display driver, the vertical blanking period may be longer than one horizontal scan period.

The performing of the shift operation in the vertical blanking period makes it possible to reliably prevent disruptions of the display by noise due to electrostatic or other sources.

According to one embodiment of the present invention, there is provided a display driver which drives a plurality of data lines of a display panel including a plurality of scan lines, the data lines and a plurality of pixels, based on display data, the display driver comprising:

a display data bus to which display data is supplied in accordance with the sequence in which the data lines are arranged;

a shift register which has a plurality of flip-flops connected in series, shifts a shift start signal based on a shift clock, and outputs shift outputs from the flip-flops;

a shift register control circuit which supplies the shift clock and the shift start signal to the shift register;

a data latch which has a plurality of flip-flops and fetches display data on the display data bus, based on the shift outputs from the flip-flops of the shift register; and a drive circuit which drives the data lines, based on the display data that has been fetched into the data latch, wherein:

the shift register control circuit supplies the shift clock to the shift register in a vertical scan period in which the scan lines are scanned, to cause the shift register to fetch display data for one horizontal scan, then halts the supply of the shift clock to the register; and the shift register control circuit initializes the flip-flops of the shift register to clear the contents held in the shift register in a vertical blanking period between the vertical scan period and the next vertical scan period.

In this display driver, after the shift register control circuit has supplied the shift clock to the shift register to cause the shift register to fetch display data in the vertical scan period, the shift register control circuit halts the supply of the shift clock to the shift register. This makes it possible to make the shift register stop performing unnecessary shift operations, enabling a reduced power consumption.

In addition, the shift register control circuit can clear the contents held by the shift register by initializing the shift register in the vertical blanking period. If the shift operation of the shift register is halted after the display data for one horizontal scan has been fetched, for example, a state could occur in which unpredictable data that is based on pulses generated by noise or the like is fetched into the shift register. In such a case, it is possible to clear the unpredictable data (or delete unpredictable data that is based on pulses generated by noise or the like) in a period unrelated to the display.

Furthermore, since the vertical blanking period is employed instead of the horizontal blanking period, the increase in power consumption entailed by the initialization of the shift register can be reduced to the reciprocal of the number of horizontal scan periods (or the number of horizontal scan lines) within one vertical scan period.

In this display driver, the shift register control circuit may initialize the flip-flops of the shift register in a vertical blanking period between one vertical scan period of a plurality of vertical scan periods and the next one of the vertical scan periods.

Since this makes it possible to reduce the frequency at which the contents held in the shift register are cleared, the power consumption involved in the initialization of the shift register in the vertical blanking period can be greatly reduced. Moreover, this is also extremely effective in reducing the power consumption in cases in which there would be no problems caused by canceling display disruptions every once in a plurality of vertical blanking periods, since human eyes cannot discern display disruptions within one vertical scan period.

In this display driver, the shift register control circuit may halt the supply of the shift clock to the shift register in the vertical scan period, based on a shift output from a final-stage flip-flop of the flip-flops of the shift register.

This makes it possible to implement control of the halting of the supply of the shift clock, with a simple configuration.

The display driver may further comprise a mode setting register which sets a first or a second mode, wherein:

when the first mode has been set in the mode setting register, in the vertical scan period, the shift register control circuit may supply the shift clock to the shift register to cause the shift register to fetch display data for one horizontal scan, then halt the supply of the shift clock to the shift register, and in the vertical blanking period, the shift register control circuit may supply the shift clock to the shift register or initialize the flip-flops of the shift register to clear the contents held in the shift register; and when the second mode has been set in the mode setting register, the shift register control circuit may supply the shift clock to the shift register to cause the shift register to fetch display data for one horizontal scan, then either continue the supply of the shift clock to the shift register or initialize the flip-flops of the shift register to clear the contents held in the shift register.

In general, the horizontal scan period is determined by the size of the display panel that the display driver drives, in contrast to the vertical scan period which is fixed. The vertical blanking period could therefore be shorter than one horizontal scan period. In the first mode, one horizontal scan period is necessary for clearing the contents of the shift register within the vertical blanking period. For that reason, if the vertical blanking period is greater than or equal to one horizontal scan period, the setting of the first mode would reduce the power consumption, and also make it possible to prevent display disruptions due to electrostatic or other sources. In contrast thereto, if the vertical blanking period is shorter than one horizontal scan period, setting the second mode increases the power consumption to a certain extent, but makes it possible to prevent display disruptions due to electrostatic or other sources. This makes it possible to provide a display driver which is designed to reduce power consumption and which also prevents display disruptions due to electrostatic or other sources, without any dependence on the display panel to be driven.

According to one embodiment of the present invention, there is provided an electro-optical device comprising:

a plurality of scan lines;

a plurality of data lines;

a plurality of pixels each of which is connected to one of the scan lines and one of the data lines;

a scan driver which drives the scan lines; and any of the above display drivers which drive the data lines.

This makes it possible to provide an electro-optical device that is designed to be inexpensive and also less power consuming.

These embodiments of the present invention are further described below with reference to the accompanying figures.

1. Liquid-Crystal Display Device

The configuration of an active matrix type of liquid-crystal display device including a display driver according to one embodiment of the present invention is shown in FIG. 1.

A liquid-crystal display device (generally speaking: an electro-optical device) 10 includes a liquid-crystal display panel (generally speaking: a display panel or optical panel) 20.

The liquid-crystal display panel 20 could be formed on a glass substrate, by way of example. On this glass substrate are disposed a plurality of scan lines (gate lines) GL1 to GLM (where M is an integer greater than or equal to 2), which extend in the X direction and are disposed in the Y direction, and a plurality of data lines (source lines) DL1 to DLN (where N is an integer greater than or equal to 2), which extend in the Y direction and are disposed in the X direction. A pixel area (pixel) is provided to correspond to the position at which the scan line GLm (where $1 \leqq m \leqq M$, and m is an integer, hereinafter the same) crosses the data line DLn (where $1 \leqq n \leqq N$, and n is an integer, hereinafter the same), and a thin-film transistor (TTF) 22 nm is disposed in that pixel area.

The gate of the TFT 22 nm is connected to the scan line GLn. The source of the TFT 22 mn is connected to the data line DLn. The drain of the TFT 22 mn is connected to a pixel electrode 26 mn. A liquid crystal is inserted between the pixel electrode 26 mn and an opposing electrode 28 mn that faces it, to form a liquid crystal capacitance (generally speaking: a liquid crystal element) 24 mn. The configuration is such that the transmissivity of the pixel varies with the voltage applied between the pixel electrode 26 mn and the opposing electrode 28 mn. An opposing electrode voltage Vcom is supplied to the opposing electrode 28 mn.

This liquid-crystal display panel 20 is formed by sandwiching a first substrate on which is formed the pixel electrodes and TFTs and a second substrate on which is formed the opposing electrodes, then inserting a liquid crystal as an electro-optical material between the two substrates, by way of example.

The liquid-crystal display device 10 includes a display driver (more specifically: a data driver) 30. The display driver 30 drives the data lines DL1 to DLN of the liquid-crystal display panel 20, based on display data.

The liquid-crystal display device 10 can also include a gate driver (scan driver) 32. The gate driver 32 scans the scan lines GL1 to GLM of the liquid-crystal display panel 20 within one vertical scan period.

The liquid-crystal display device 10 includes a power circuit 40. The power circuit 40 generates the voltages necessary for driving the data lines and supplies them to the display driver 30. The power circuit 40 generates power voltages VDDH and VSSH that are necessary for driving the data lines of the display driver 30 and the voltage for the logic portions of the display driver 30, by way of example.

The power circuit 40 also generates the voltages necessary for scanning the scan lines, and supplies them to the gate driver 32. The power circuit 40 also generates the opposing electrode voltage Vcom. The power circuit 40 outputs the opposing electrode voltage Vcom, which periodically switches from a first high-potential voltage VCOMH to a first low-potential voltage VCOML at the timing of a polarity inversion signal POL that is generated by the display driver 30, to each opposing electrode of the liquid-crystal display panel 20.

The liquid-crystal display device 10 can also include a display controller 38. The display controller 38 controls the display driver 30, the gate driver 32, and the power circuit 40 in accordance with details set by a host such as a central processing unit (CPU) that is not shown in the figure. For example, the display controller 38 sets an operating mode and supplies internally generated vertical and horizontal synchronization signals.

Note that the configuration shown in FIG. 1 has the power circuit 40 and the display controller 38 included within the liquid-crystal display device 10, but the configuration could be such that at least one of these components is provided outside the liquid-crystal display device 10. Alternatively, the configuration could be such that the host capability is provided within the liquid-crystal display device 10.

The display driver 30 could also have at least one of the gate driver 32 and the power circuit 40 therein.

Figure 2:
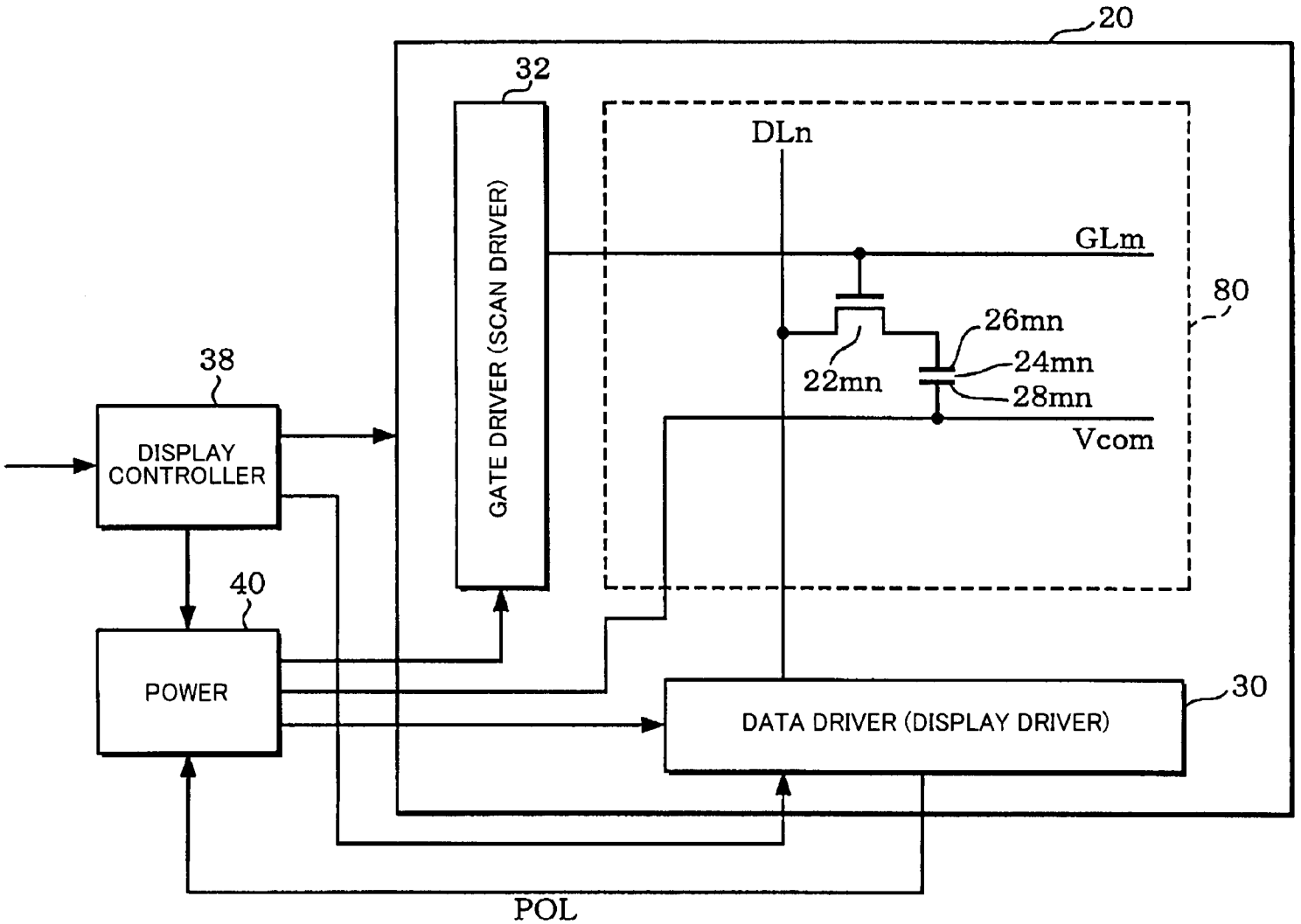
FIG. 2 schematically shows another example of the configuration of an active matrix type of liquid-crystal display device including a display driver according to one embodiment of the present invention.

Furthermore, some or all of the display driver 30, the gate driver 32, the display controller 38, and the power circuit 40 could be formed on the liquid-crystal display panel 20. For example, the display driver 30 and the gate driver 32 could be formed on the liquid-crystal display panel 20, as shown in FIG. 2. This liquid-crystal display panel 20 could have a configuration including a plurality of data lines, a plurality of scan lines, a plurality of switch elements connected to scan lines of the plurality of scan lines and data lines of the plurality of data lines, and a display driver that drives the plurality of data lines. A plurality of pixels are formed in a pixel formation area 80 of the liquid-crystal display panel 20.

2. Display Driver

The display driver 30 of this embodiment fetches display data that is supplied serially in pixel units over a display data bus, into a data latch. For that reason, the display driver 30 includes a shift register that generates a latch clock for fetching the display data into the data latch. Stages of the shift output of this shift register become a latch clock. Thus, serially-supplied display data can be fetched into the data latch at a desired timing by synchronizing the timing at which display data is supplied to the display data bus and the shift timing of the shift register.

If the design is such that power consumption is reduced during the fetching of display data in the thus-configured display driver 30, it is effective to halt the operation of the shift register. Since the shift register bases the shift operation on a shift clock, it is effective to halt the supply of that shift clock. For example, it is possible to halt the supply of the shift clock after display data for one horizontal scan has been fetched, until the supply of the next display data starts. This makes it possible to reduce the power consumption at a lower cost, without affecting the array of display data that the display controller 38 supplies.

However, it could happen that noise due to electrostatic or other sources is superimposed on a horizontal synchronization signal HSYNC or the like. In such a case, pulses generated by the noise would activate the shift operation by the shift register. If the supply of the shift clock is halted with the objective of reducing power consumption, data that has been affected by such pulses will remain in the shift register. When the supply of display data is started at the next horizontal scan period, the data is shifted within the shift register. The fetching of display data that ought not to have been fetched into the data latch originally could prevent the correct display of the image.

In such a case, the display driver 30 of this embodiment halts the supply of the shift clock after display data for one horizontal scan has been fetched in the vertical scan period, and also performs the shift operation of the shift register in the vertical blanking period between one vertical scan period and the vertical scan period after that vertical scan period. This not only reduces the consumption of power by unnecessary shift operations, it also makes it possible to prevent display disruptions caused by noise due to electrostatic or other sources.

Figure 3:
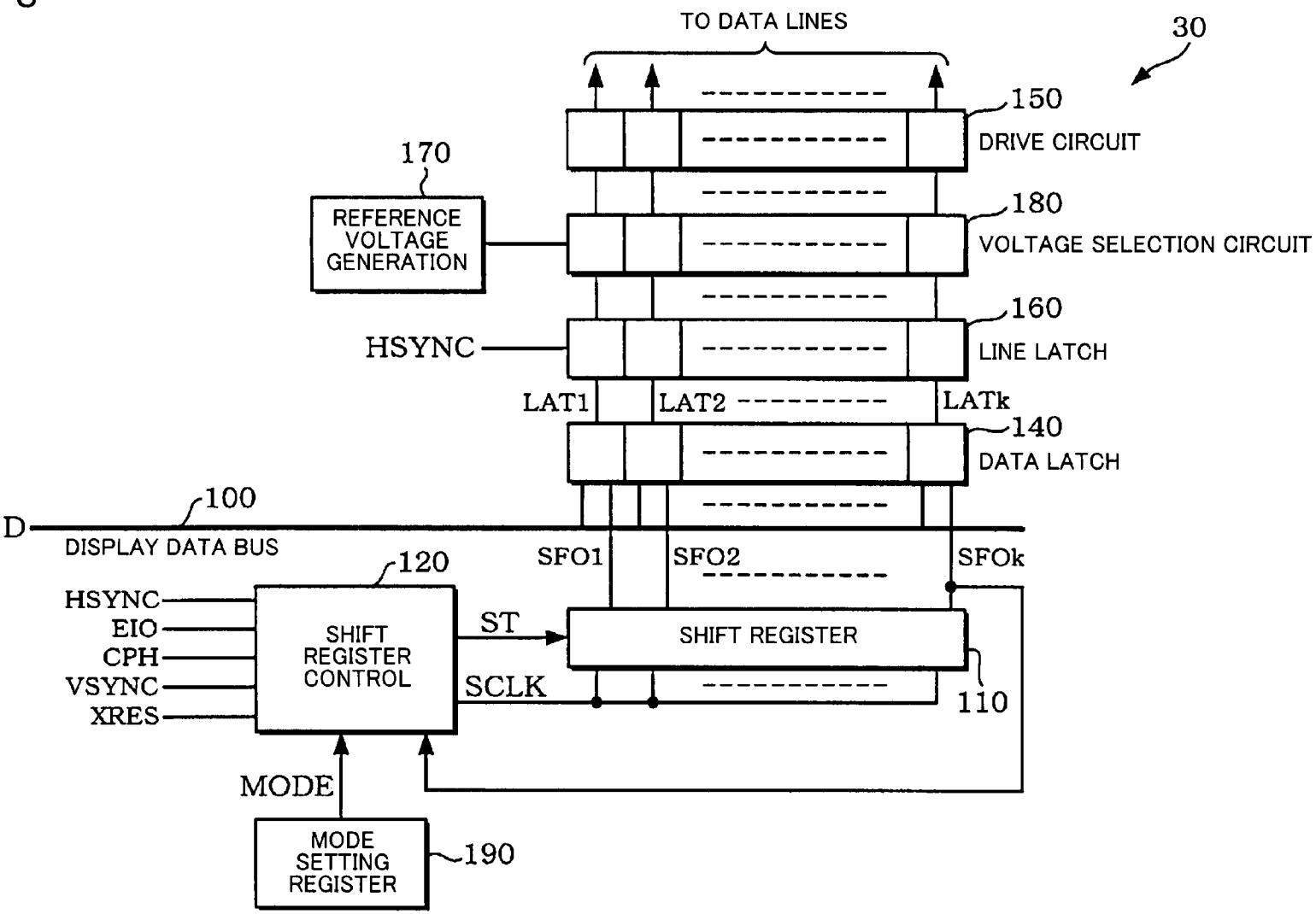
FIG. 3 is a block diagram showing the configuration of the display driver according to one embodiment of the present invention.

A block diagram showing the configuration of the display driver 30 according to one embodiment of the present invention is shown in FIG. 3.

The display driver 30 includes a display data bus 100, a shift register 110, a shift register control circuit 120, a data latch 140, and a drive circuit 150.

Display data is supplied to the display data bus 100 in accordance with the sequence of the plurality of data lines of the liquid-crystal display panel 20. For example, the data is supplied to the display data bus 100 in the sequence of display data D1 for driving the data line DL1, display data D2 for driving the data line DL2, . . . up to display data DN for driving the data line DLN. The display data is supplied by the display controller 38 of FIG. 1.

The shift register 110 has a plurality of serially connected flip-flops, and shifts a shift start signal ST based on a shift clock SCLK to output shift outputs SFO1 to SFOk (where k is an integer greater than or equal to 2) from the flip-flops.

The shift register control circuit 120 controls the shift operation of the shift register 110. More specifically, the shift register control circuit 120 can control the timing of the shift operation of the shift register 110 by generating the shift clock SCLK and supplying the shift clock SCLK to the shift register 110. The shift register control circuit 120 can also supply the shift clock SCLK to the shift register 110 or halt the supply of the shift clock SCLK thereto. The shift register control circuit 120 can also control the start timing of the shift operation of the shift register 110, by generating the shift start signal ST and supplying the shift start signal ST to the shift register 110.

The data latch 140 has a plurality of flip-flops for fetching display data on the display data bus 100, based on the shift output of the shift register 110.

The drive circuit 150 drives the plurality of data lines, based on the display data that has been fetched into the data latch 140.

Figure 4:
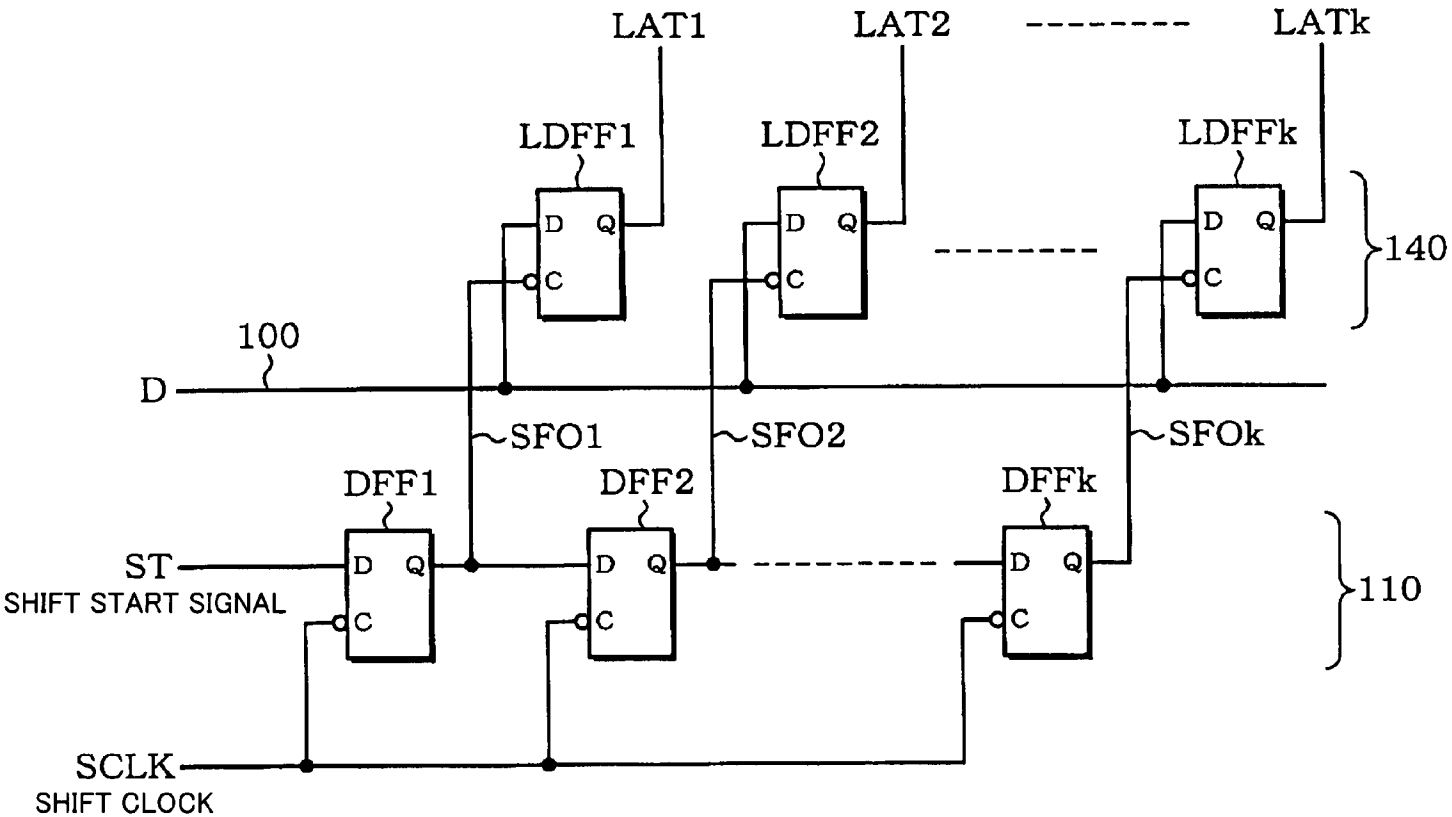
FIG. 4 a circuit diagram showing the configuration of the display data bus, shift register, and data latch according to one embodiment of the present invention.

An example of the configuration of the display data bus 100, the shift register 110, and the data latch 140 is shown in FIG. 4.

The shift register 110 has first to kth (where k is an integer greater than or equal to 2) D flip-flops (hereinafter abbreviated to DFFs). The ith DFF (where $1 \leqq i \leqq k$, and i is an integer) is hereinafter denoted by DFFi. Each DFF includes a data input terminal D, a clock input terminal C, and a data output terminal Q. It holds the logic level of a signal that is input to the data input terminal D at the falling edge (or rising edge, generally speaking, a transition point) of a signal input to the clock input terminal C, and outputs the thus-held logic level data from the data output terminal Q. The shift register 110 is configured of the serially connected DFF1 to DFFk. In other words, the data output terminal Q of DFFj (where $1 \leqq j \leqq k-1$, and j is an integer) is connected to the D of the next-stage DFF(j+1). The shift output SFOi is a signal from the data output terminal Q of DFFi.

The shift start signal ST is input to the Data input terminal D of DFF1. The shift clock SCLK (or an inverted signal thereof) is input in common to the clock input terminals C of DFF1 to DFFk.

The data latch 140 has first to kth (where k is an integer greater than or equal to 2) latching D-flip-flops. The ith latching DFF (where $1 \leqq i \leqq k$, and i is an integer) is hereinafter denoted by LDFFi. Each LDFF includes a data input terminal D, a clock input terminal C, and a data output terminal Q. It holds the logic level of a signal that is input to the data input terminal D at the falling edge (or rising edge, generally speaking, a transition point) of a signal input to the clock input terminal C, and outputs the thus-held logic level data from the data output terminal Q. However, an LDFF holds a plurality of bits of data. The shift output SFOi that is output from the data output terminal Q of DFFi is supplied to the clock input terminal C of LDFFi. Latch data LATi is data of the data output terminal Q of LDFFi. The data input terminals D of LDFF1 to LDFFk are connected in common to the display data bus 100.

Figure 5:
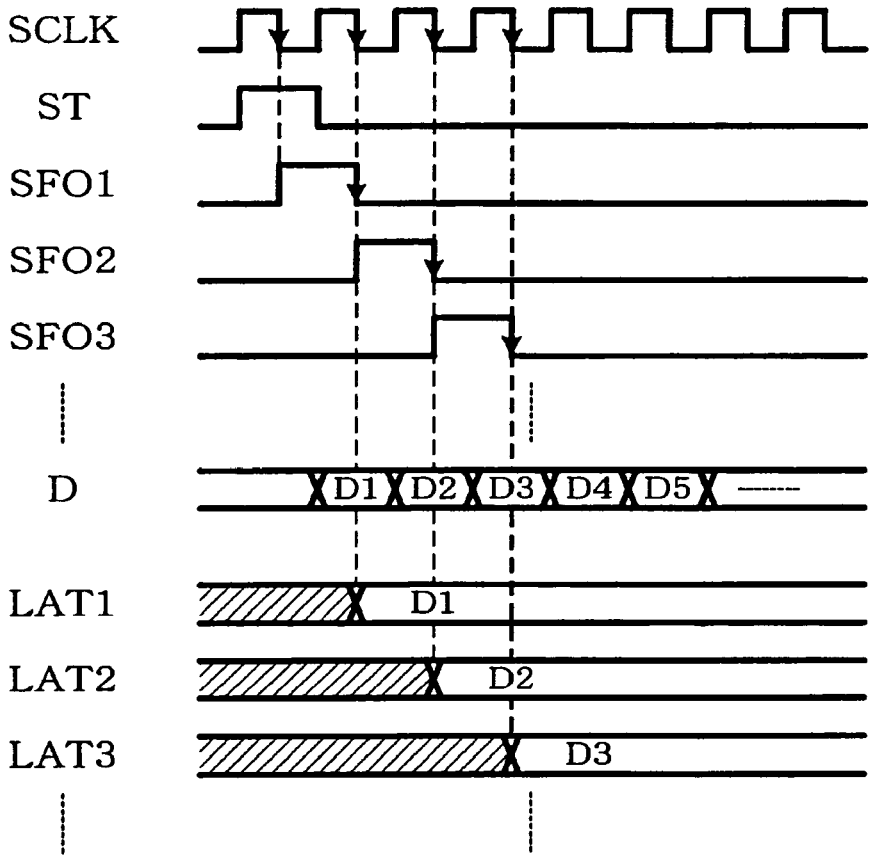
FIG. 5 is a timing chart showing an example of the operation of the shift register and data latch of FIG. 4.

The timing of an example of the operation of the shift register 110 and the data latch 140 of FIG. 4 is shown in FIG. 5.

The shift register 110 fetches the shift start signal ST, which is a pulse signal, at the falling edge of the shift clock SCLK. The shift register 110 then performs the shift operation in synchronization with the fall of the shift clock SCLK, to sequentially output the stages of shift output SFO1 to SFOk.

The data latch 140 fetches display data on the display data bus 100 at the falling edge of each stage of the shift output of the shift register 110, and outputs it as the latch data LAT1 to LATk.

The thus-configured shift register control circuit 120 of the display driver 30 supplies the shift clock SCLK to the shift register 110 in the vertical scan period in which the plurality of scan lines are scanned. After the shift register 110 has fetched the display data for one horizontal scan, the supply of the shift clock SCLK to the display data bus 100 halts. In addition, the shift clock SCLK is supplied to the shift register 110 in the vertical blanking period between one vertical scan period and the next vertical scan period.

Figure 6:
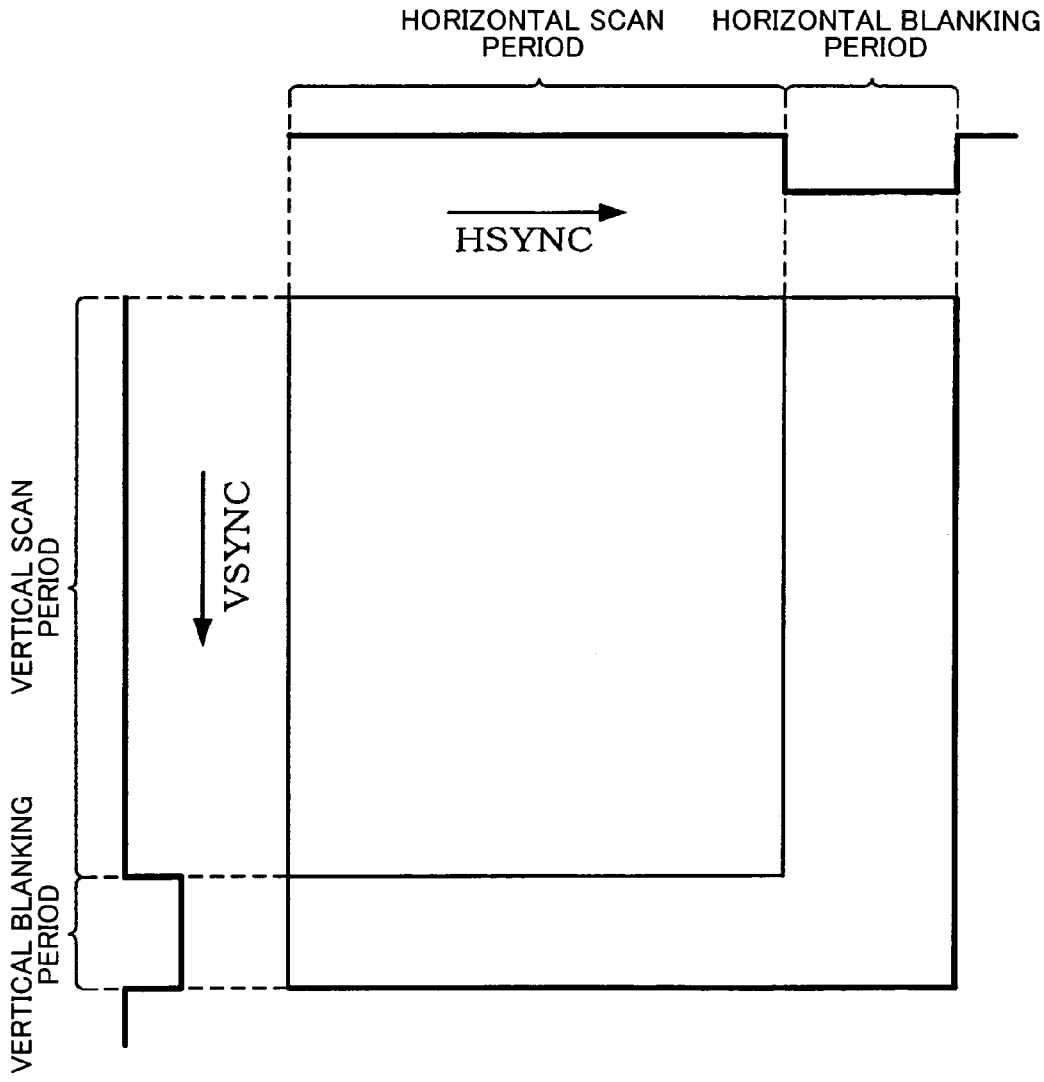
FIG. 6 is a diagram for illustrating a vertical blanking period according to one embodiment of the present invention.

The vertical blanking period in this embodiment is illustrated in FIG. 6

The horizontal scan period is regulated by the horizontal synchronization signal HSYNC. In the horizontal scan period, the drive voltages are supplied to the pixels connected to the selected scan lines, through the data lines. In FIG. 6, the period during which the horizontal synchronization signal HSYNC is high is the horizontal scan period and the period during which the horizontal synchronization signal HSYNC is low is a horizontal blanking period.

The vertical scan period is regulated by a vertical synchronization signal VSYNC. In the vertical scan period, a plurality of scan lines are selected sequentially in units of one or a plurality of scan lines. The vertical scan period includes a plurality of horizontal scan periods and a plurality of horizontal blanking periods. In FIG. 6, the period during which the vertical synchronization signal VSYNC is high is the vertical scan period and the period during which the vertical synchronization signal VSYNC is low is the vertical blanking period.

Thus the display driver 30 causes the shift register control circuit 120 to fetch the display data for the horizontal scan period after the current horizontal scan period into the shift register 110, by supplying the shift clock SCLK to the shift register 110 in the vertical scan period. After the display data for the next horizontal scan period has been fetched within the vertical scan period, the shift operation of the shift register 110 can be halted by halting the supply of the shift clock SCLK to the shift register 110, making it possible to design a reduced power consumption.

In addition, the shift register control circuit 120 can start the shift operation of the shift register 110 in a period unrelated to the display, by supplying the shift clock SCLK to the shift register 110 in the vertical blanking period, not the horizontal blanking period. This makes it possible to ensure that any unpredictable data is output from the shift register 110 in a period unrelated to the display, even if a state should occur in which unpredictable data that is based on pulses generated by noise or the like is fetched into the shift register 110, if the shift operation of the shift register 110 is halted after display data for one horizontal scan has been fetched. In other words, it is possible to clear the contents held in the shift register (delete unpredictable data that is based on pulses generated by noise or the like). For that reason, it is preferable than the vertical blanking period is longer than one horizontal scan period. This makes it possible to prevent display disruptions caused by noise due to electrostatic or other sources. Since the vertical blanking period is employed instead of the horizontal blanking period, the increase in power consumption entailed by the outputting from the shift register 110 of data caused by noise due to electrostatic or other sources can be reduced to the reciprocal of the number of horizontal scan periods (the number of horizontal scan lines) within one vertical scan period.

The display driver 30 of this embodiment includes a mode setting register 190 for setting a first or a second mode, as shown in FIG. 3. The display driver 30 changes the period during which the clearing of the contents held in the shift register 110 is controlled, in accordance with the mode set in the mode setting register 190.

Figure 7:
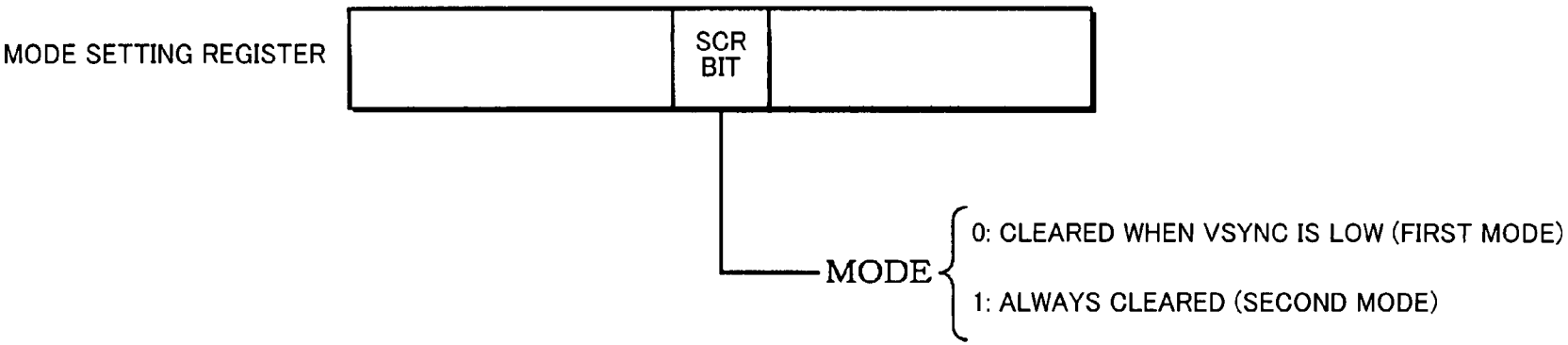
FIG. 7 is a diagram for illustrating a mode setting register according to one embodiment of the present invention.

The mode setting register 190 is shown in FIG. 7.

The value of the mode setting register 190 is set by the display controller 38. A shift register clear (SCR) bit is provided at a predetermined position of the mode setting register 190. The display driver 30 is set to the first mode when the SCR bit has been set to 0 and the display driver 30 is set to the second mode when the SCR bit has been set to 1.

In the first mode, the shift register control circuit 120 halts the supply of the shift clock SCLK after the display data for one horizontal scan has been fetched, but supplies the shift clock SCLK in the vertical blanking period.

In the second mode, the shift register control circuit 120 does not halt the supply of the shift clock SCLK in the vertical scan period and the vertical blanking period.

The shift register control circuit 120 implements control in the above-described first and second modes by switching between a low-power mode and a non-low-power mode that will be described later. In the low-power mode, the shift register control circuit 120 halts the supply of the shift clock SCLK to the shift register 110 after the display data for one horizontal scan has been fetched into the shift register 110. In the non-low-power mode, the shift register control circuit 120 continues to supply the shift clock SCLK to the shift register 110, even after the display data for one horizontal scan has been fetched into the shift register 110.

Figure 8:
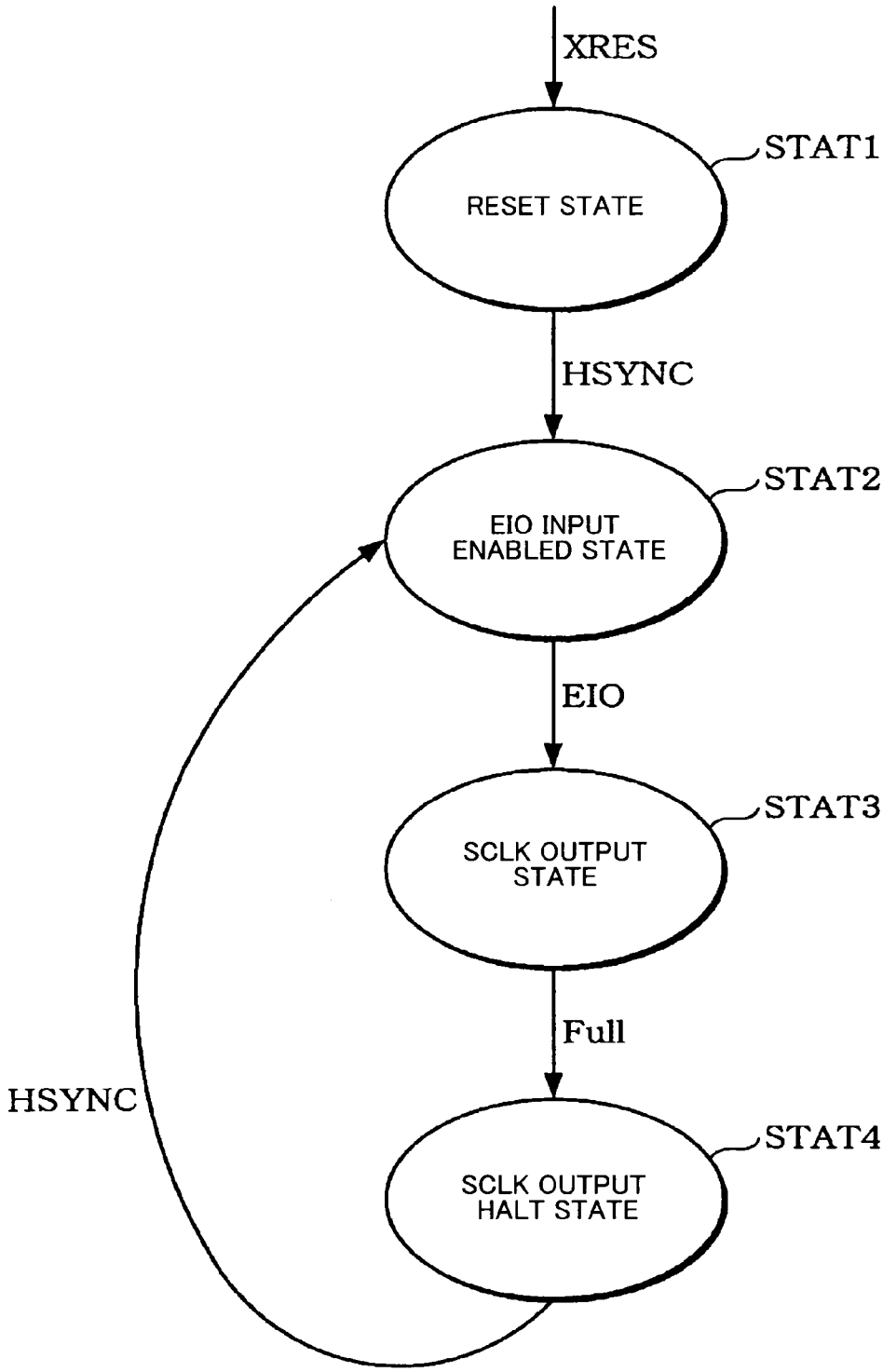
FIG. 8 shows an example of a state transition diagram for illustrating the operation in a low-power mode.

An example of a state transition diagram illustrating the operation in low-power mode is shown in FIG. 8.

When a reset signal XRES becomes active in low-power mode, the state changes to a reset state STAT1. During this reset state STAT1, the various portions in the display driver 30 are set to an initial state.

When the horizontal synchronization signal HSYNC goes active in the reset state STAT1, the state changes to an enable input-output signal EIO input-enabled state STAT2.

When the enable input-output signal EIO becomes active in the enable input-output signal EIO input-enabled state STAT2, the state changes to a shift clock SCLK output state STAT3. In other words, when the enable input-output signal EIO becomes active, the shift start signal ST is supplied to the shift register 110. The shift register control circuit 120 could start the supply of the shift clock SCLK to the shift register 110 on condition that the state has changed to the enable input-output signal EIO input-enabled state STAT2, but the shift register control circuit 120 could also start the supply of the shift clock SCLK to the shift register 110 on condition that the enable input-output signal EIO has become active in the enable input-output signal EIO input-enabled state STAT2.

In the shift clock SCLK output state STAT3, the shift register control circuit 120 supplies the shift clock SCLK to the shift register 110. Thus the above-described shift operation is performed in the shift register 110. Therefore display data for one horizontal scan is fetched into the shift register 110.

When display data for one horizontal scan is fetched into the shift register 110, a data full signal Full (or a signal for generating the data full signal Full) is output from the shift register 110 and the state changes to a shift clock SCLK output halt state STAT4.

In the shift clock SCLK output halt state STAT4, the shift register control circuit 120 halts the supply of the shift clock SCLK to the shift register 110, based on the data full signal Full.

If the horizontal synchronization signal HSYNC becomes active in the shift clock SCLK output halt state STAT4, the state changes to the enable input-output signal EIO input-enabled state STAT2.

Figure 9:
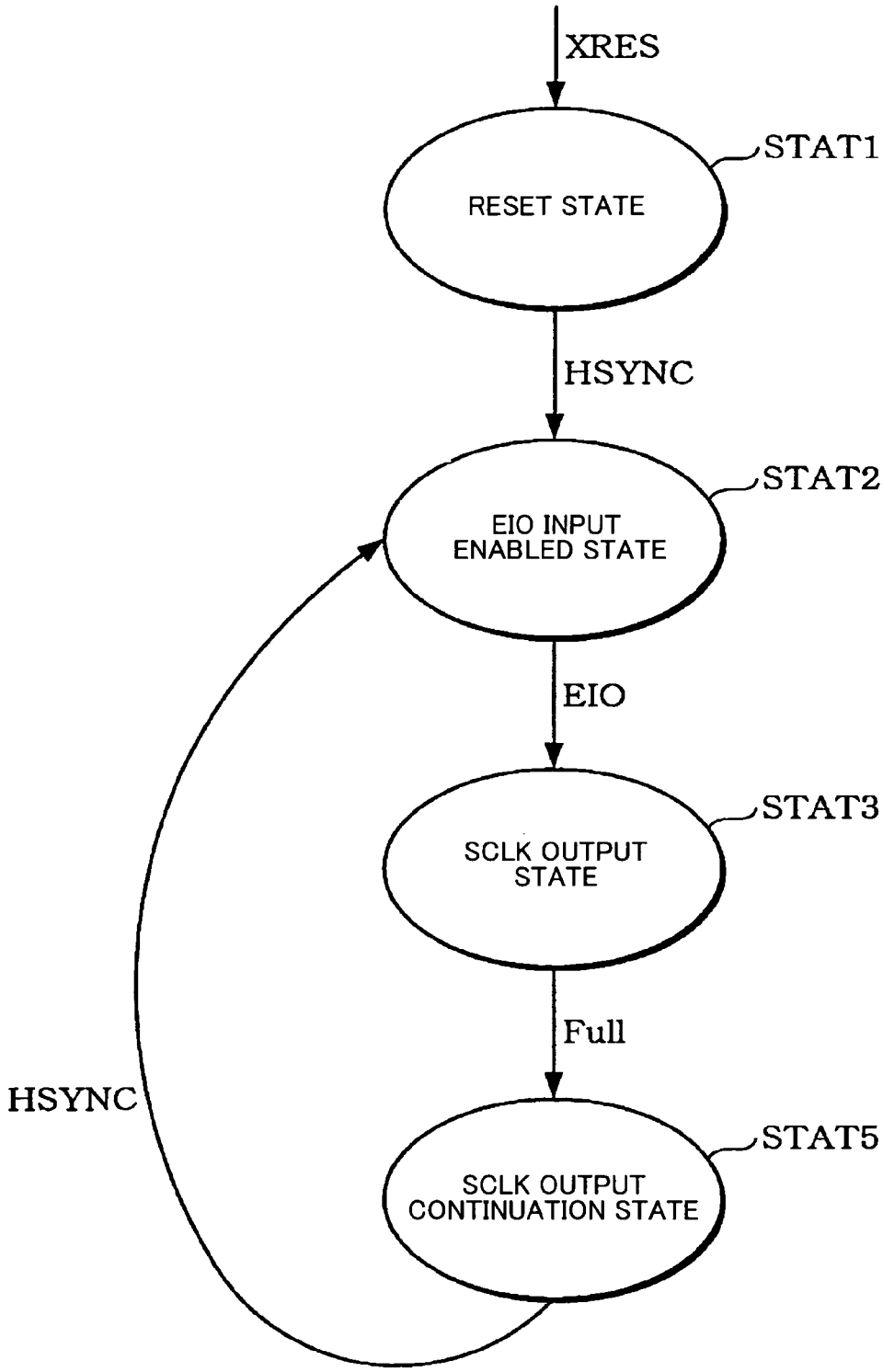
FIG. 9 shows an example of a state transition diagram for illustrating the operation in a non-low-power mode.

An example of a state transition diagram illustrating the operation in non-low-power mode is shown in FIG. 9. It should be noted that components that are the same as those of the low-power mode shown in FIG. 8 are denoted by the same reference numbers, and further description is omitted.

Since the state transitions to the reset state STAT1, the enable input-output signal EIO input-enabled state STAT2, and the shift clock SCLK output state STAT3 of the non-low-power mode are the same as those in low-power mode shown in FIG. 8, further description is omitted.

If the data full signal Full becomes active in the shift clock SCLK output state STAT3 of this non-low-power mode, the state changes to a shift clock SCLK output continuation state STAT5.

In the shift clock SCLK output continuation state STAT5, the shift register control circuit 120 does not halt the supply of the shift clock SCLK to the shift register 110 and continues to supply the shift clock SCLK thereto.

If the horizontal synchronization signal HSYNC becomes active in the shift clock SCLK output continuation state STAT5, the state changes to the enable input-output signal EIO input-enabled state STAT2.

In the first mode, the shift register control circuit 120 controls the vertical scan period (the period during which the vertical synchronization signal VSYNC is high) in low-power mode and the vertical blanking period (the period during which the vertical synchronization signal VSYNC is low) in non-low-power mode.

In other words, in the first mode, the shift register control circuit 120 supplies the shift clock SCLK to the shift register 110 in the vertical scan period to cause the shift register 110 to fetch the display data for one horizontal scan, then halts the supply of the shift clock SCLK to the shift register 110, and supplies the shift clock SCLK to the shift register 110 in the vertical blanking period.

In the second mode, the shift register control circuit 120 controls without changing the non-low-power mode. Thus the shift register control circuit 120 supplies the shift clock SCLK to the shift register 110 even in the vertical blanking period.

In other words, the shift register control circuit 120 supplies the shift clock SCLK to the shift register 110 in the vertical scan period to cause the shift register 110 to fetch the display data for one horizontal scan, then continues to supply the shift clock SCLK to the shift register 110.

In general, the horizontal scan period is determined by the size of the liquid-crystal display panel 20 that the display driver 30 drives, in contrast to the vertical scan period that is fixed. The vertical blanking period could therefore be shorter than one horizontal scan period. In the above-described first mode, one horizontal scan period is necessary for clearing the contents of the shift register 110 within the vertical blanking period. For that reason, if the vertical blanking period is greater than or equal to one horizontal scan period, the setting of the first mode would reduce the power consumption, and also make it possible to prevent display disruptions due to electrostatic or other sources. In contrast thereto, if the vertical blanking period is shorter than one horizontal scan period, setting the second mode increases the power consumption to a certain extent, but makes it possible to prevent display disruptions due to electrostatic or other sources.

Figure 10:
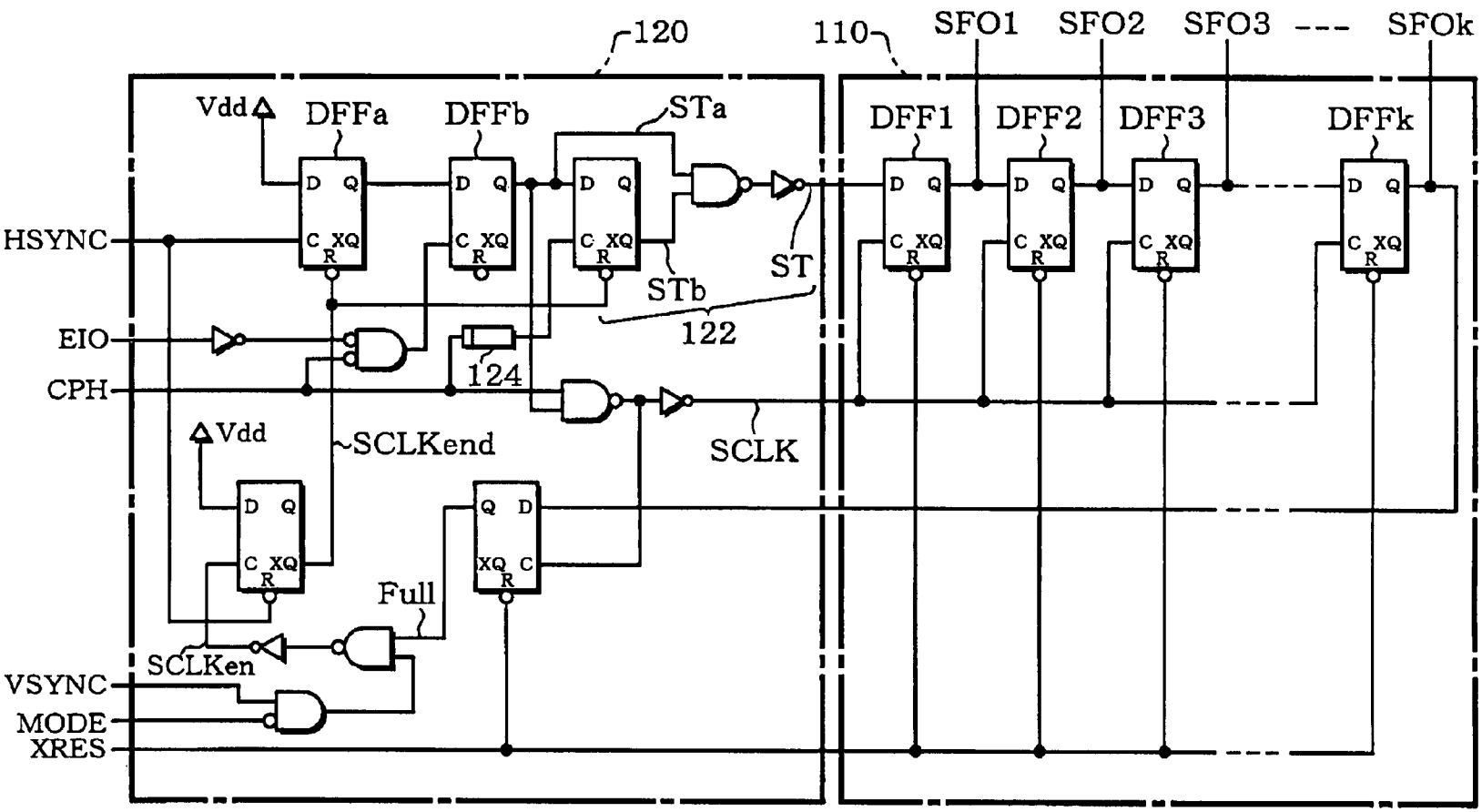
FIG. 10 is a circuit diagram showing an example of the configuration of a shift register control circuit according to one embodiment of the present invention.

A circuit diagram of an example of the configuration of the shift register control circuit 120 is shown in FIG. 10. A circuit diagram of an example of the configuration of the shift register 110 is also shown in FIG. 10. Note that components that are the same as portions in FIGS. 3 and 4 are denoted by the same reference numbers and further description thereof is omitted.

The reset signal XRES, the horizontal synchronization signal HSYNC, the vertical synchronization signal VSYNC, a mode setting signal MODE, the enable input-output signal EIO, and a dot clock CPH are input to the shift register control circuit 120.

The reset signal XRES initializes the shift register control circuit 120. The horizontal synchronization signal HSYNC regulates one horizontal scan period. The vertical synchronization signal VSYNC regulates one vertical scan period. The mode set signal MODE has a logic level corresponding to the value of the SCR bit of the mode setting register 190 of FIGS. 3 and 7. The enable input-output signal EIO indicates the start of supply of display data. The shift start signal ST is generated by using the enable input-output signal EIO. The dot clock CPH is a clock. Display data that is supplied in pixel units is output to the display data bus 100 in sync with the dot clock CPH.

DFFa and DFFb are circuits for detecting a predetermined sequence after the input of the horizontal synchronization signal HSYNC. More specifically, DFFa is a circuit for causing a transition from the reset state STAT1 to the enable input-output signal EIO input-enabled state STAT2, as shown in FIGS. 8 and 9. DFFb is a circuit for causing a transition from the enable input-output signal EIO input-enabled state STAT2 to the shift clock SCLK output state STAT3, as shown in FIGS. 8 and 9.

A shift start signal generation circuit 122 of the shift register control circuit 120 generates the shift start signal ST. The shift start signal generation circuit 122 detects the rising of DFFb and generates the shift start signal ST that has a pulse width of the length of delay time of a delay element 124.

The shift register control circuit 120 ANDs the output of DFFb and the dot clock CPH, and outputs the result as the shift clock SCLK.

The shift register control circuit 120 generates the data full signal Full by fetching the shift output SFOk of the shift register 110, based on a NAND of the output of DFFb and the dot clock CPH.

It also generates a shift clock halt control signal SCLKend for causing a transition to the shift clock SCLK output halt state STAT4 or the shift clock SCLK output continuation state STAT5 of the first or second mode, using the vertical synchronization signal VSYNC, the mode setting signal MODE, and the data full signal Full. The transition to the shift clock SCLK output halt state STAT4 is caused by initializing DFFa, DFFb, and the shift start signal generation circuit 122, based on the shift clock halt control signal SCLKend. If the state has changed to the shift clock SCLK output continuation state STAT5, it is assumed that DFFa, DFFb, and the shift start signal generation circuit 122 are not initialized by the shift clock halt control signal SCLKend.

Figure 11:
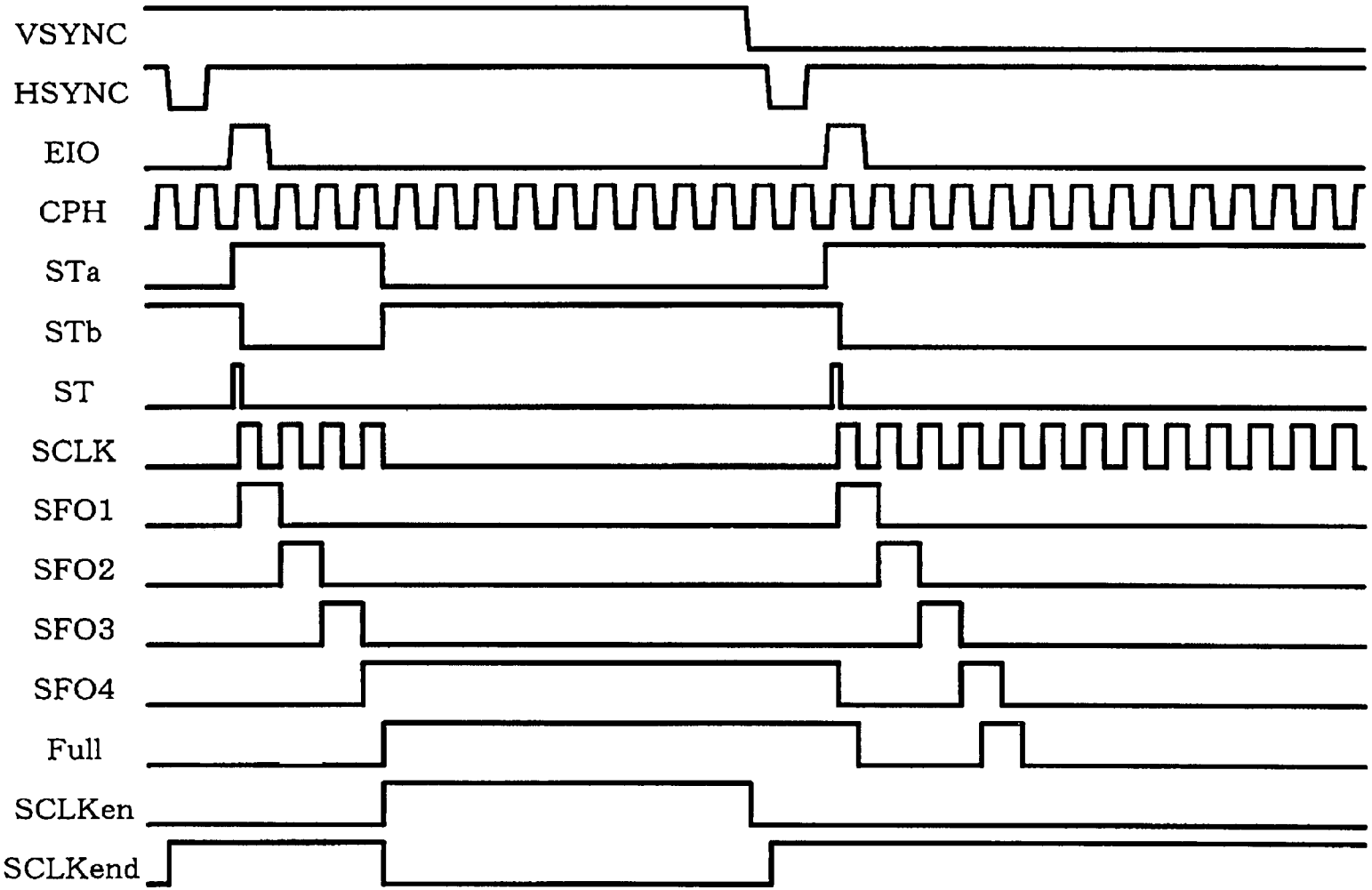
FIG. 11 is a timing chart of an example of the operation of the shift register control circuit of FIG. 10.

An example of the operational timing of the shift register control circuit 120 of FIG. 10 is shown in FIG. 11. FIG. 11 shows an example of the operational timing in the first mode when k is 4. To simplify the figure, the vertical scan period is assumed to include only one horizontal scan period.

The shift clock SCLK is output if the horizontal synchronization signal HSYNC changes from low to high in the vertical scan period in which the vertical synchronization signal VSYNC is high, starting one horizontal scan period. The data full signal Full is made active by the shift output SFO4. This makes it possible to halt the supply of the shift clock SCLK after the display data for one horizontal scan has been fetched.

In the vertical blanking period in which the vertical synchronization signal VSYNC is low, the shift clock halt control signal SCLKend changes and the supply of the shift clock SCLK restarts.

The display data on the display data bus 100 is fetched into the data latch 140, based on the shift output of the shift register 110 that is controlled in the above manner.

In the display driver 30, the drive circuit 150 drives the data lines, based on the display data that has been fetched into the data latch 140.

More specifically, the display driver 30 further includes a line latch 160, a reference voltage generation circuit 170 and a voltage selection circuit 180, as shown in FIG. 3.

The line latch 160 latches the display data for one horizontal scan that has been latched into the data latch 140, based on the horizontal synchronization signal HSYNC.

The reference voltage generation circuit 170 generates a plurality of reference voltages, where the reference voltages correspond to the display data. More specifically, the reference voltage generation circuit 170 generates a plurality of reference voltages, where the reference voltages correspond to display data of a plurality of bits, based on a high-potential-side power voltage VDDH and a low-potential-side selected voltage VSSH.

The voltage selection circuit 180 generates a drive voltage for each data line, corresponding to the display data that is output from the line latch 160. More specifically, the voltage selection circuit 180 selects a reference voltage corresponding to the display data for one output from the line latch 160, from the plurality of reference voltages generated by the reference voltage generation circuit 170, and outputs the selected reference voltage as a drive voltage.

The drive circuit 150 drives the data lines of the liquid-crystal display panel 20 based on the drive voltages that have been output from the voltage selection circuit 180. More specifically, the drive circuit 150 drives each data line based on a drive voltage that has been generated for each data line by the voltage selection circuit 180. Each data line drive circuit of the drive circuit 150 includes a plurality of data line drive circuits DRV-1 to DRV-N corresponding to the data lines. Each of the data line drive circuits DRV-1 to DRV-N is configured of an op-amp in a voltage-follower connection.

If the display data for one pixel is configured of 6 bits for each of the RGB colors, giving a total of 18 bits, the display data bus 100 has a bus width of 18 bits. The data latch 140 fetches the display data in 18-bit units, based on the shift outputs of the shift register 110. In addition, the line latch 160 latches the display data for one horizontal scan that has been fetched into the data latch 140, based on the horizontal synchronization signal HSYNC.

Figure 12:
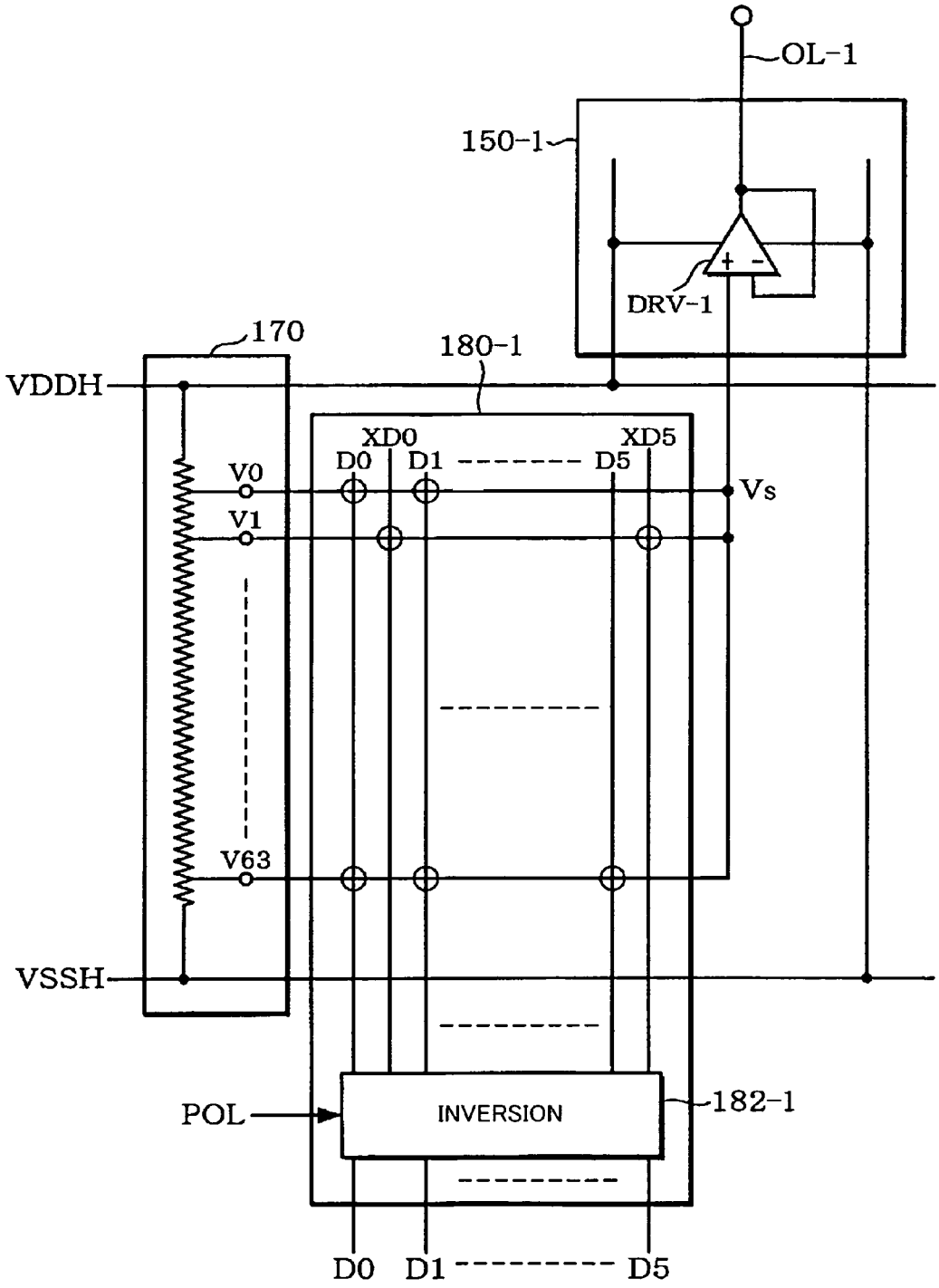
FIG. 12 schematically shows the configuration of the reference voltage generation circuit, voltage selection circuit, and drive circuit according to one embodiment of the present invention.

The configuration of the reference voltage generation circuit, voltage selection circuit, and drive circuit is schematically shown in FIG. 12. In this case, only the configuration for one output is shown. FIG. 12 show the configuration for outputting the 6-bit R signal for forming one pixel. The other outputs can be implemented by a similar configuration. The configurational example shows a polarity inversion drive in which the polarity of the voltage applied between the pixel electrode and the opposing electrode inverts in synchronization with the polarity inversion signal POL.

The reference voltage generation circuit 170 connects a resistance circuit between the high-potential-side power voltage VDDH and the low-potential-side selected voltage VSSH. The reference voltage generation circuit 170 generates a plurality of divided voltages by dividing the voltage between the high-potential-side power voltage VDDH and the low-potential-side selected voltage VSSH, as reference voltages V0 to V63. Note that since the voltages are not symmetrical between positive and negative polarities when polarity inversion drive is performed, a reference voltage for positive polarities and a reference voltage for negative polarities are generated. FIG. 12 shows one of these.

A voltage selection circuit 180-1 could be implemented by a ROM decoder circuit. The voltage selection circuit 180-1 selects one of the reference voltages V0 to V63, based on the 6-bit display data, and outputs it as a selected voltage Vs to the data line drive circuit DRV-1. Note that a voltage is selected and output in a similar manner for each of the other data line drive circuits DRV-2 to DRV-N, based on the corresponding 6-bit display data.

The voltage selection circuit 180-1 includes an inversion circuit 182-1. The inversion circuit 182-1 inverts the display data, based on the polarity inversion signal POL. Six bits of display data D0 to D5 and six bits of inverted display data XD0 to XD5 are input to the voltage selection circuit 180-1. The inverted display data XD0 to XD5 is a bit inversion of the corresponding bits of display data D0 to D5. In the voltage selection circuit 180-1, one of the multivalue reference voltages V0 to V63 generated by the reference voltage generation circuit 170 is selected, based on the display data.

If the logic level of the polarity inversion signal POL is high, for example, reference voltage V2 is selected to correspond to the 6-bit display data D0 to D5 "000010" (=2). If the logic level of the polarity inversion signal POL is low, as a further example, the reference voltage is selected by using the inverted display data XD0 to XD5, which is an inversion of the display data D0 to D5. In other words, the inverted display data XD0 to XD5 is "111101" (=61) and reference voltage V61 is selected.

The selected voltage Vs that has been selected by the voltage selection circuit 180-1 in this manner is supplied to the data line drive circuit DRV-1.

The data line drive circuit DRV-1 drives an output line OL-1, based on the selected voltage Vs. The output line OL-1 is connected to the data line DL1 of the liquid-crystal display panel 20, by way of example.

3. First Variant Example

In the shift register control circuit 120 of FIG. 10, the shift clock SCLK is supplied to the shift register 110 in each vertical blanking period, but the present invention is not limited thereto. A shift register control circuit in accordance with a first variant example of the present invention supplies the shift clock SCLK to the shift register 110 in a any one vertical scan period of a plurality of vertical scan periods and the vertical blanking period between that vertical scan period and the next vertical scan period. In other words, the shift register control circuit of this first variant example supplies the shift clock SCLK to the shift register 110 only in one vertical blanking period of a plurality of vertical blanking periods. This makes it possible to greatly reduce the power consumption entailed by the shift operation of the shift register 110 in the vertical blanking period. Moreover, this is also effective in cases in which there would be no problems caused by canceling display disruptions every once in a plurality of vertical blanking periods, since human eyes cannot discern display disruptions within one vertical scan period.

Figure 13:
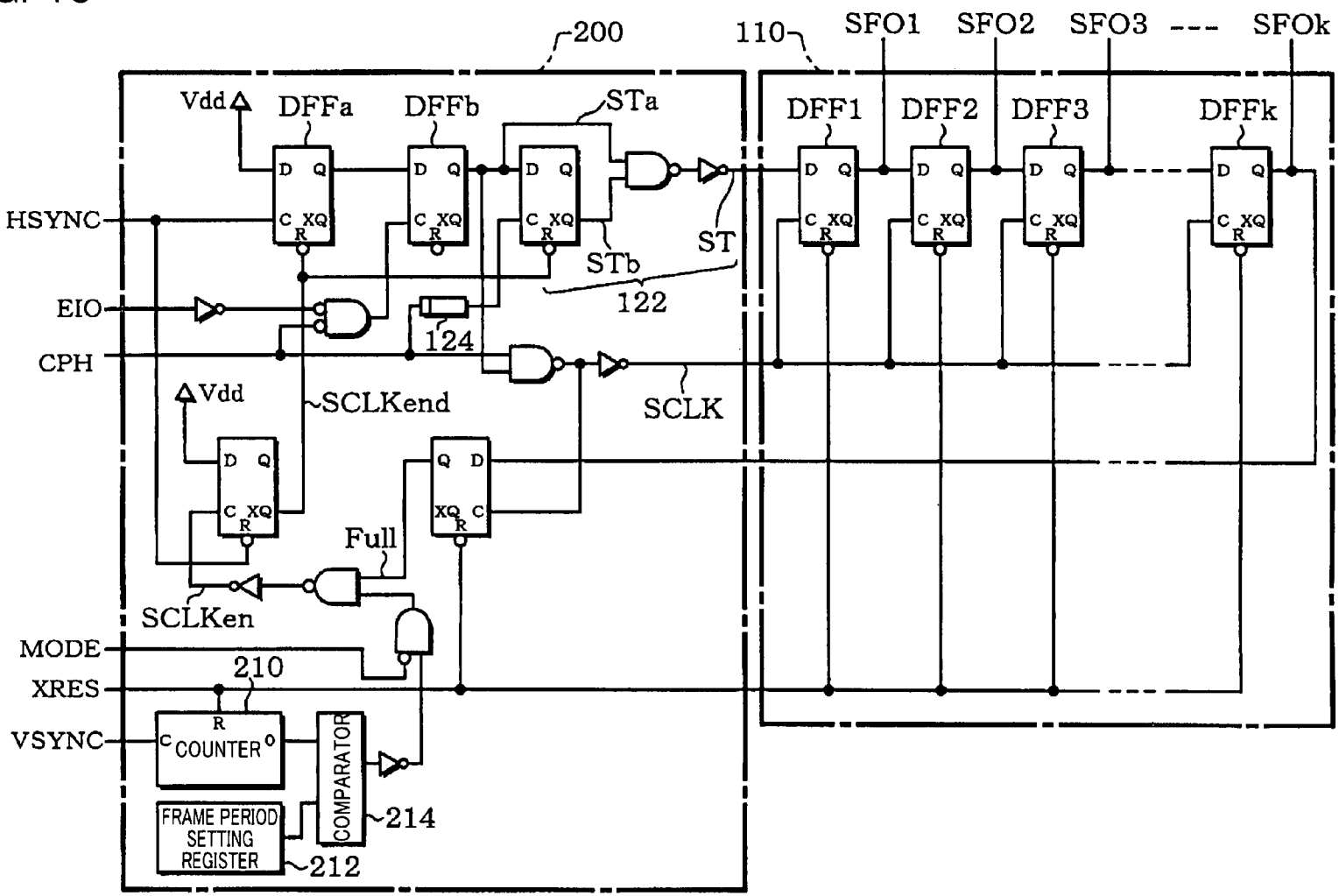
FIG. 13 is a circuit diagram showing the configuration of a shift register control circuit according to a first variant example of the present invention.

A circuit diagram showing the configuration of a shift register control circuit in accordance with a first variant example of the present invention is shown in FIG. 13.

The display driver 30 of FIG. 3 can employ a shift register control circuit 200 of this first variant example instead of the shift register control circuit 120. A circuit diagram of an example of the configuration of the shift register 110 therefor is shown in FIG. 13. Note that components that are the same as portions in FIGS. 3, 4, and 10 are denoted by the same reference numbers and further description thereof is omitted.

The shift register control circuit 200 differs from the shift register control circuit 120 of FIG. 3 in that it includes a counter 210, a frame period setting register 212, and a comparator 214.

The counter 210 counts the rising or falling edges of the vertical synchronization signal VSYNC and outputs that count to the comparator 214. The counter 210 is initialized by the reset signal XRES.

The setting of the frame period setting register 212 is set by the display controller 38.

The comparator 214 compares the count of the counter 210 and the setting of the frame period setting register 212 and outputs a pulse corresponding to the result of the comparison. The comparator 214 outputs a pulse if the result of the comparison shows that the count matches the setting, by way of example.

The generation of the shift clock halt control signal SCLKend is based on the data full signal Full and the comparison result of the comparator 214.

Figure 14:
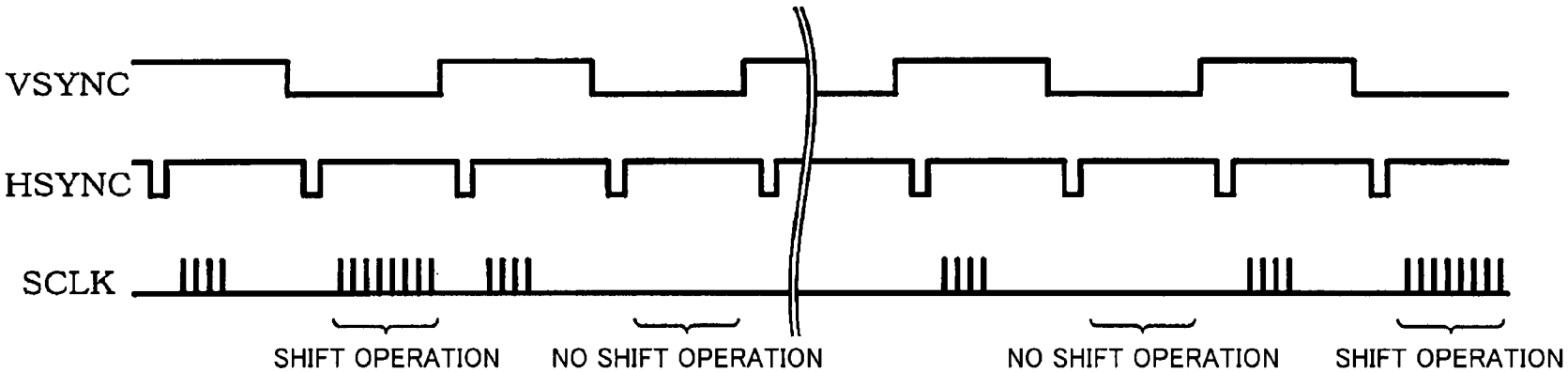
FIG. 14 is a timing chart schematically showing an example of the operation of the shift register control circuit of FIG. 13.

An example of the operational timing of the shift register control circuit 200 of FIG. 13 is shown schematically in FIG. 14. FIG. 14 shows an example of the operational timing in the first mode when k is 4. To simplify the figure, the vertical scan period is assumed to include only one horizontal scan period.

By using the shift clock halt control signal SCLKend that has been generated as described above, the shift clock SCLK is supplied to the shift register 110 only in one vertical blanking period of a plurality of vertical blanking periods.

4. Second Variant Example

A shift register control circuit in accordance with a second variant example of the present invention initializes a plurality of flip-flops of the shift register 110 in the vertical blanking period. This cancels the effects due to data caused by electrostatic or other sources, making it possible to prevent display disruptions due to electrostatic or other sources.

Figure 15:
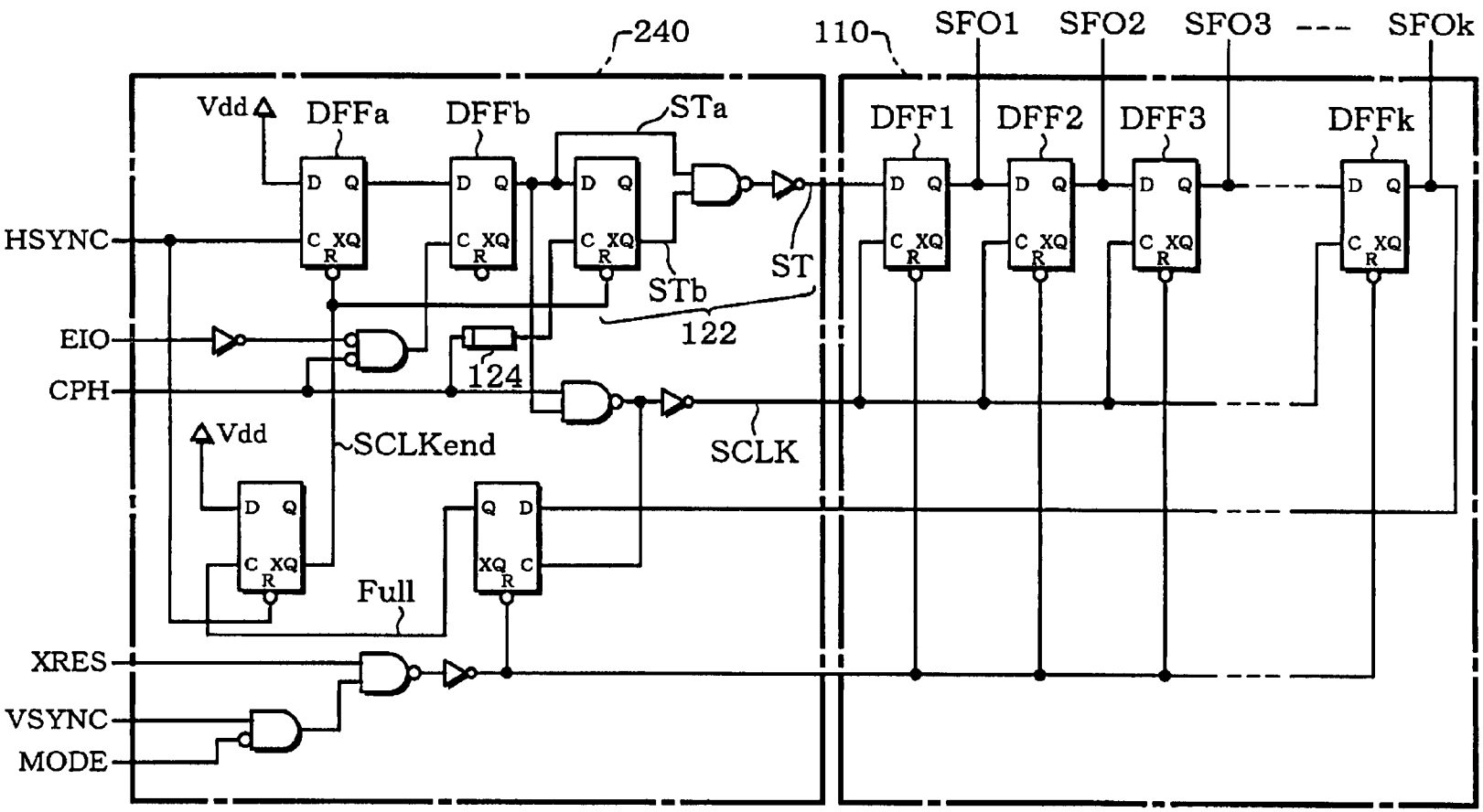
FIG. 15 is a circuit diagram showing the configuration of a shift register control circuit according to a second variant example of the present invention.

A circuit diagram of the configuration of a shift register control circuit in accordance with a second variant example of the present invention is shown in FIG. 15.

The display driver 30 of FIG. 3 could employ a shift register control circuit 240 of this second variant example instead of the shift register control circuit 120. A circuit diagram of an example of the configuration of the shift register 110 therefor is shown in FIG. 15. Note that portions that are the same as portions in FIGS. 3, 4, and 10 are denoted by the same reference numbers and further description thereof is omitted.

The shift register control circuit 240 differs from the shift register control circuit 120 of FIG. 3 in that it uses the vertical synchronization signal VSYNC to initialize DFF1 to DFFk of the shift register 110.

In FIG. 15, the halting of the supply of the shift clock SCLK is based on the data full signal Full, irrespective of the mode set by the mode set signal MODE, reducing the power consumption entailed in the shift operation.

5. Third Variant Example

In the shift register control circuit 240 of FIG. 15, DFF1 to DFFk of the shift register 110 are initialized in each vertical blanking period, but the present invention is not limited thereto. A shift register control circuit in accordance with a third variant example of this invention initializes DFF1 to DFFk of the shift register 110 in the vertical blanking period between one of a plurality of vertical scan periods and the next vertical scan period after that vertical scan period. This makes it possible to greatly reduce the power consumption entailed by the initialization of DFF1 to DFFk of the shift register 110. This is also effective in cases in which there would be no problems caused by canceling display disruptions every once in a plurality of vertical blanking periods, since human eyes cannot discern display disruptions within one vertical scan period.

Figure 16:
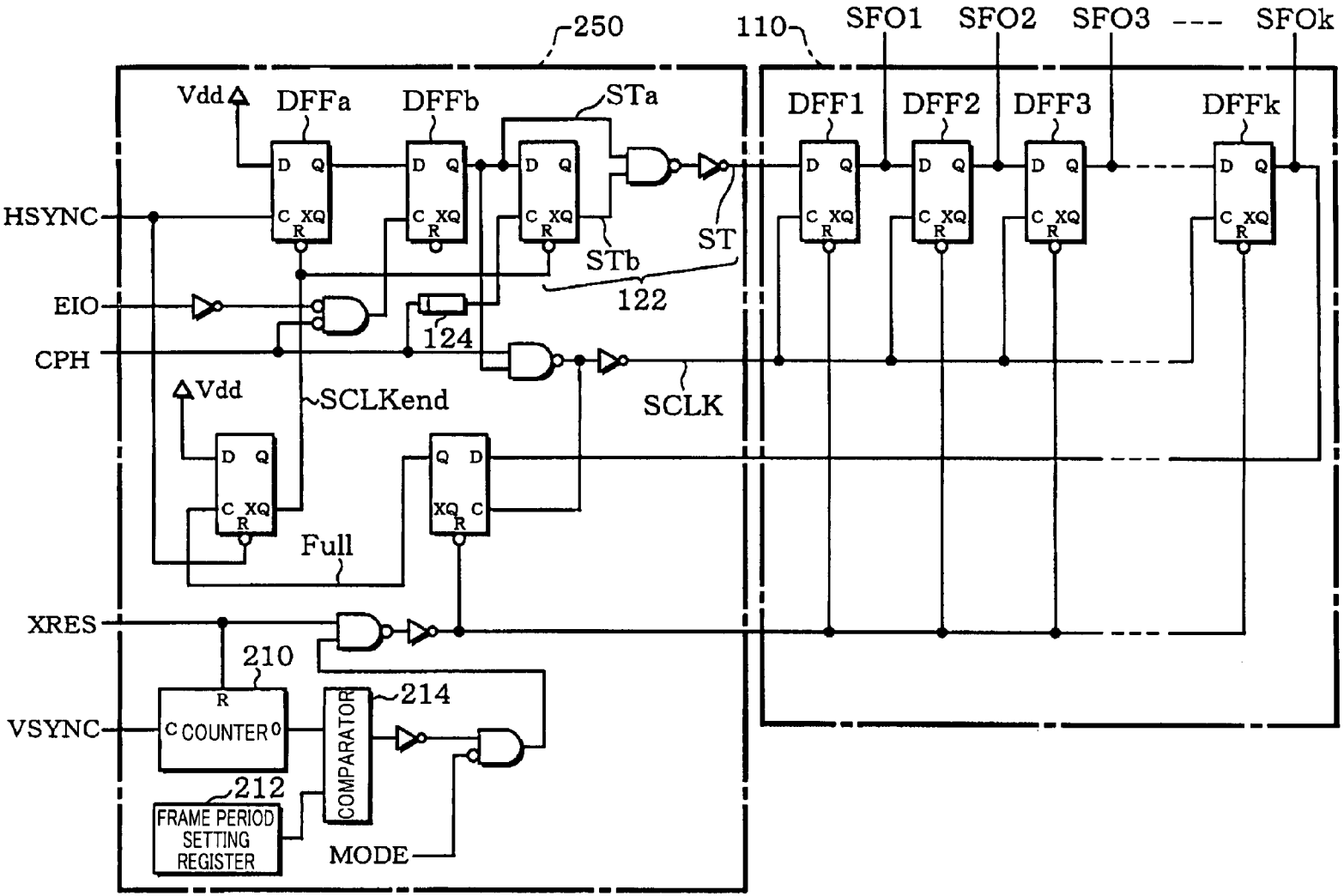
FIG. 16 is a circuit diagram showing the configuration of a shift register control circuit according to a third variant example of the present invention.

A circuit diagram of the configuration of a shift register control circuit in accordance with the third variant example of the present invention is shown in FIG. 16.

The display driver 30 of FIG. 3 can employ a shift register control circuit 250 in accordance with this third variant example instead of the shift register control circuit 120. A circuit diagram of an example of the configuration of the shift register 110 therefor is shown in FIG. 16. Note that components that are the same as portions in FIGS. 3, 4, 10, and 13 are denoted by the same reference numbers and further description thereof is omitted.

The shift register control circuit 250 differs from the shift register control circuit 240 of FIG. 15 in that it includes the counter 210, the frame period setting register 212, and the comparator 214.

The comparator 214 compares the count of the counter 210 and the setting of the frame period setting register 212 and outputs a pulse corresponding to the result of the comparison.

The result of the comparison is used to initialize DFF1 to DFFk of the shift register 110. This ensures that DFF1 to DFFk of the shift register 110 are initialized only in one vertical blanking period of a plurality of vertical blanking periods.

In FIG. 16, the halting of the supply of the shift clock SCLK is based on the data full signal Full, irrespective of the mode set by the mode set signal MODE, to reduce the power consumption entailed by the shift operation.

Note that the present invention is not limited to the above-described embodiments and thus various modifications thereto are possible within the scope of the present invention. For example, the present invention is not limited to the driving of a liquid-crystal display panel as described above; it can also be applied to the driving of an electroluminescent or plasma display device. It can also be applied to a passive-matrix type of liquid-crystal panel.

Part of requirements of any claim of the present invention could be omitted from a dependent claim which depends on that claim. Moreover, part of requirements of any independent claim of the present invention could be made to depend on any other independent claim.

What is claimed is:

1. A display driver that drives a plurality of data lines of a display panel including a plurality of scan lines, the plurality of data lines and a plurality of pixels, based on display data, the display driver comprising:

a display data bus to which display data is supplied in accordance with the sequence in which the data lines are arranged;

a shift register that has a plurality of flip-flops connected in series, shifts a shift start signal based on a shift clock, and outputs shift outputs from the flip-flops;

a shift register control circuit that supplies the shift clock and the shift start signal to the shift register;

a data latch that has a plurality of flip-flops and fetches display data on the display data bus, based on the shift outputs from the flip-flops of the shift register; and a drive circuit that drives the data lines, based on the display data that has been fetched into the data latch, the shift register control circuit supplying the shift clock to the shift register in a vertical scan period in which the scan lines are scanned, to cause the shift register to fetch display data for one horizontal scan, then halting the supply of the shift clock to the register; and the shift register control circuit supplying the shift clock to the shift register in a vertical blanking period between the vertical scan period and next vertical scan period, to clear contents held in the shift register;

the display driver further comprising a mode setting register that sets a first mode or a second mode;

when the first mode has been set in the mode setting register, the shift register control circuit supplying the shift clock to the shift register to cause the shift register to fetch display data for one horizontal scan in each of a plurality of horizontal scan periods included in the vertical scan period, then halting the supply of the shift clock to the shift register in the each of the plurality of horizontal scan periods included in the vertical scan period, and the shift register control circuit supplying the shift clock to the shift register or initializing the flip-flops of the shift register to clear the contents held in the shift register in the vertical blanking period; and when the second mode has been set in the mode setting register, the shift register control circuit supplying the shift clock to the shift register to cause the shift register to fetch display data for one horizontal scan, then supplying the shift clock to the shift register to clear contents held in the shift register.

2. The display driver as defined in claim 1, the vertical blanking period being longer than one horizontal scan period.

3. The display driver as defined in claim 1, the shift register control circuit halting the supply of the shift clock to the shift register in the each of the plurality of horizontal scan periods included in the vertical scan period, based on a shift output from a final-stage flip-flop of the flip-flops of the shift register.

4. An electro-optical device comprising:

a plurality of scan lines;

a plurality of data lines;

a plurality of pixels each of which is connected to one of the scan lines and one of the data lines;

a scan driver that drives the scan lines; and the display driver as defined in claim 1 that drives the data lines.

5. A display driver that drives a plurality of data lines of a display panel including a plurality of scan lines, the plurality of data lines and a plurality of pixels, based on display data, the display driver comprising:

a display data bus to which display data is supplied in accordance with the sequence in which the data lines are arranged;

a shift register that has a plurality of flip-flops connected in series, shifts a shift start signal based on a shift clock, and outputs shift outputs from the flip-flops;

a shift register control circuit that supplies the shift clock and the shift start signal to the shift register;

a data latch that has a plurality of flip-flops and fetches display data on the display data bus, based on the shift outputs from the flip-flops of the shift register; and a drive circuit that drives the data lines, based on the display data that has been fetched into the data latch, the shift register control circuit supplying the shift clock to the shift register in one of a plurality of vertical scan periods in each of which the scan lines are scanned, to cause the shift register to fetch display data for one horizontal scan, then halting the supply of the shift clock to the register; and the shift register control circuit supplying the shift clock to the shift register in a vertical blanking period between one of the vertical scan periods and next vertical scan period, to clear contents held in the shift register;

the display driver further comprising a mode setting register that sets a first mode or a second mode;

when the first mode has been set in the mode setting register, the shift register control circuit supplying the shift clock to the shift register to cause the shift register to fetch display data for one corresponding horizontal scan in each of a plurality of horizontal scan periods included in the one of the plurality of vertical scan periods, then halting the supply of the shift clock to the shift register in the each of the plurality of horizontal scan periods included in the one of the plurality of vertical scan periods, and the shift register control circuit supplying the shift clock to the shift register or initializing the flip-flops of the shift register to clear the contents held in the shift register in the vertical blanking period; and when the second mode has been set in the mode setting register, the shift register control circuit supplying the shift clock to the shift register to cause the shift register to fetch display data for one horizontal scan, then supplying the shift clock to the shift register to clear contents held in the shift register.

6. The display driver as defined in claim 5, the vertical blanking period being longer than one horizontal scan period.

7. The display driver as defined in claim 5, the shift register control circuit halting the supply of the shift clock to the shift register in the each of the plurality of horizontal scan periods included in one of the vertical scan periods, based on a shift output from a final-stage flip-flop of the flip-flops of the shift register.

8. An electro-optical device comprising:

a plurality of scan lines;

a plurality of data lines;

a plurality of pixels each of which is connected to one of the scan lines and one of the data lines;

a scan driver that drives the scan lines; and the display driver as defined in claim 5 that drives the data lines.

9. A display driver that drives a plurality of data lines of a display panel including a plurality of scan lines, the plurality of data lines and a plurality of pixels, based on display data, the display driver comprising:

a display data bus to which display data is supplied in accordance with the sequence in which the data lines are arranged;

a shift register that has a plurality of flip-flops connected in series, shifts a shift start signal based on a shift clock, and outputs shift outputs from the flip-flops;

a shift register control circuit that supplies the shift clock and the shift start signal to the shift register;

a data latch that has a plurality of flip-flops and fetches display data on the display data bus, based on the shift outputs from the flip-flops of the shift register; and a drive circuit that drives the data lines, based on the display data that has been fetched into the data latch, the shift register control circuit supplying the shift clock to the shift register in a vertical scan period in which the scan lines are scanned, to cause the shift register to fetch display data for one horizontal scan, then halting the supply of the shift clock to the register; and the shift register control circuit initializing the flip-flops of the shift register to clear the contents held in the shift register in a vertical blanking period between the vertical scan period and next vertical scan period;

the display driver further comprising a mode setting register that sets a first mode or a second mode;

when the first mode has been set in the mode setting register, the shift register control circuit supplying the shift clock to the shift register to cause the shift register to fetch display data for one corresponding horizontal scan in each of a plurality of horizontal scan periods included in the vertical scan period, then halting the supply of the shift clock to the shift register in the each of the plurality of horizontal scan periods included in the vertical scan period, and the shift register control circuit supplying the shift clock to the shift register or initializing the flip-flops of the shift register to clear the contents held in the shift register in the vertical blanking period; and when the second mode has been set in the mode setting register, the shift register control circuit supplying the shift clock to the shift register to cause the shift register to fetch display data for one horizontal scan, then supplying the shift clock to the shift register to clear contents held in the shift register.

10. The display driver as defined in claim 9, the shift register control circuit halting the supply of the shift clock to the shift register in the each of the plurality of horizontal scan periods included in the vertical scan period, based on a shift output from a final-stage flip-flop of the flip-flops of the shift register.

11. An electro-optical device comprising:

a plurality of scan lines;

a plurality of data lines;

a plurality of pixels each of which is connected to one of the scan lines and one of the data lines;

a scan driver that drives the scan lines; and the display driver as defined in claim 9 that drives the data lines.

12. A display driver that drives a plurality of data lines of a display panel including a plurality of scan lines, the plurality of data lines and a plurality of pixels, based on display data, the display driver comprising:

a display data bus to which display data is supplied in accordance with the sequence in which the data lines are arranged;

a shift register that has a plurality of flip-flops connected in series, shifts a shift start signal based on a shift clock, and outputs shift outputs from the flip-flops;

a shift register control circuit that supplies the shift clock and the shift start signal to the shift register;

a data latch that has a plurality of flip-flops and fetches display data on the display data bus, based on the shift outputs from the flip-flops of the shift register; and a drive circuit that drives the data lines, based on the display data that has been fetched into the data latch, the shift register control circuit supplying the shift clock to the shift register in one of a plurality of vertical scan periods in each of which the scan lines are scanned, to cause the shift register to fetch display data for one horizontal scan, then halting the supply of the shift clock to the register; and the shift register control circuit initializing the flip-flops of the shift register to clear the contents held in the shift register in a vertical blanking period between one of the vertical scan periods and next vertical scan period;

the display driver further comprising a mode setting register that sets a first mode or a second mode;

when the first mode has been set in the mode setting register, the shift register control circuit supplying the shift clock to the shift register to cause the shift register to fetch display data for corresponding one horizontal scan in each of a plurality of horizontal scan periods included in the one of the plurality of vertical scan periods, then halting the supply of the shift clock to the shift register in the each of the plurality of horizontal scan periods included in the one of the plurality of vertical scan periods, and the shift register control circuit supplying the shift clock to the shift register or initializing the flip-flops of the shift register to clear the contents held in the shift register in the vertical blanking period; and when the second mode has been set in the mode setting register, the shift register control circuit supplying the shift clock to the shift register to cause the shift register to fetch display data for one horizontal scan, then supplying the shift clock to the shift register to clear contents held in the shift register.

13. The display driver as defined in claim 12, the shift register control circuit halting the supply of the shift clock to the shift register in the each of the plurality of horizontal scan periods included in one of the vertical scan periods, based on a shift output from a final-stage flip-flop of the flip-flops of the shift register.

14. An electro-optical device comprising:

a plurality of scan lines;

a plurality of data lines;

a plurality of pixels each of which is connected to one of the scan lines and one of the data lines;

a scan driver that drives the scan lines; and the display driver as defined in claim 12 that drives the data lines.

* * * * *